US008466866B2

(12) United States Patent
Iisaka et al.

(10) Patent No.: US 8,466,866 B2
(45) Date of Patent: Jun. 18, 2013

(54) VIDEO PROCESSING CIRCUIT, VIDEO PROCESSING METHOD, LIQUID CRYSTAL DISPLAY DEVICE, AND ELECTRONIC APPARATUS

(75) Inventors: Hidehito Iisaka, Shiojiri (JP); Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 215 days.

(21) Appl. No.: 13/022,210

(22) Filed: Feb. 7, 2011

(65) Prior Publication Data

US 2011/0205208 A1 Aug. 25, 2011

(30) Foreign Application Priority Data

Feb. 25, 2010 (JP) ..... 2010-040925

(51) Int. Cl.
*G09G 3/36* (2006.01)

(52) U.S. Cl.
USPC ..... 345/89; 345/87; 345/690

(58) Field of Classification Search
USPC .... 345/84–100, 204–215, 690–699; 349/123, 349/125, 130, 134
See application file for complete search history.

(56) References Cited

U.S. PATENT DOCUMENTS 7,764,256 B2 * 7/2010 Huang et al. ..... 345/89
7,786,964 B2 * 8/2010 Sakashita ..... 345/89
7,786,965 B2 * 8/2010 Sasaki et al. ..... 345/89
7,839,380 B2 * 11/2010 Chen et al. ..... 345/102
7,956,834 B2 * 6/2011 Kang ..... 345/89
8,134,580 B2 * 3/2012 Kim et al. ..... 345/690
8,184,076 B2 * 5/2012 Katayama et al. ..... 345/87
8,242,991 B2 * 8/2012 Kato et al. ..... 345/87
2005/0001802 A1 * 1/2005 Lee ..... 345/89
2005/0030302 A1 * 2/2005 Nishi et al. ..... 345/204
2007/0063947 A1 * 3/2007 Kang ..... 345/89
2008/0018630 A1 * 1/2008 Fujino ..... 345/205
2008/0100633 A1 * 5/2008 Dallas et al. ..... 345/530
2010/0207934 A1 * 8/2010 Kato et al. ..... 345/214
2011/0176071 A1 7/2011 Iisaka et al.

FOREIGN PATENT DOCUMENTS

CN 102129849 A 7/2011
JP A-6-34965 2/1994
JP A-2009-69608 4/2009

* cited by examiner

*Primary Examiner* — Dmitriy Bolotin
(74) *Attorney, Agent, or Firm* — Oliff & Berridge, PLC

(57) ABSTRACT

A video processing circuit used in a liquid crystal panel, includes: a first boundary detector that analyzes a video signal of a present frame to detect a boundary between a first pixel and a second pixel; a second boundary detector that analyzes a video signal of a frame one frame before the present frame to detect a boundary between the first pixel and the second pixel; a correction portion that corrects an applied voltage to a liquid crystal device corresponding to a second pixel which is adjacent to a portion of the boundary detected by the first boundary detector, which is changed from the boundary detected by the second boundary detector from the applied voltage specified by the video signal of the present frame to a voltage equal to or higher than the first voltage and lower than the second voltage.

20 Claims, 19 Drawing Sheets

SCANNING LINE DRIVE CIRCUIT

VIDEO PROCESSING CIRCUIT (1) VIDEO SIGNAL (PREVIOUS FRAME)

(2) VIDEO SIGNAL (PRESENT FRAME)

(3) BOUNDARY COMPARISON (4) APPLIED BOUNDARY DETERMINATION (5) CORRECTION PROCESS (ONE PIXEL ON HIGH POTENTIAL SIDE)

FIG. 8A <NORMALLY BLACK MODE>
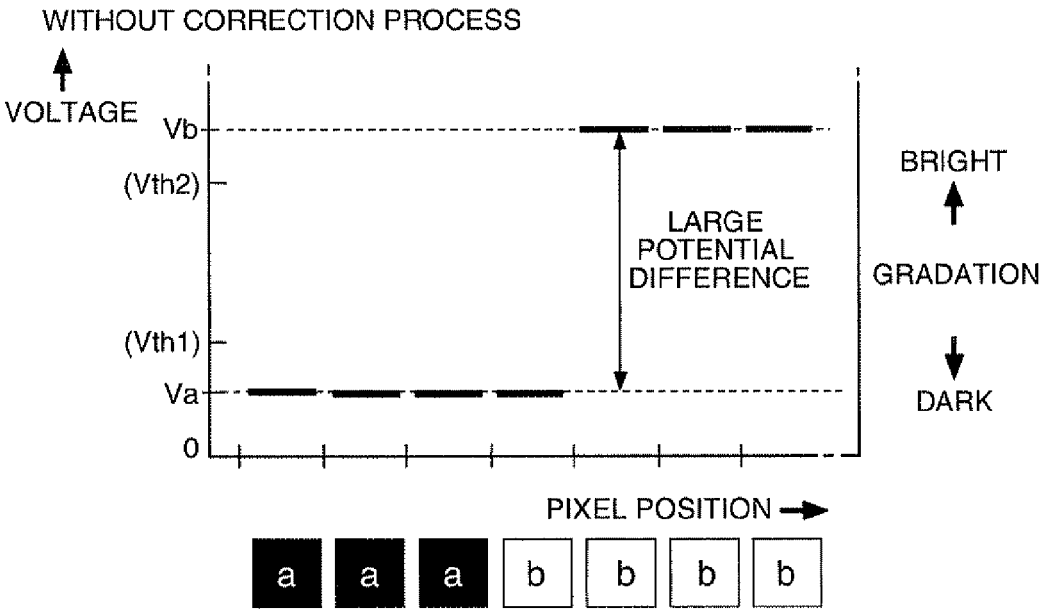
FIG. 8B
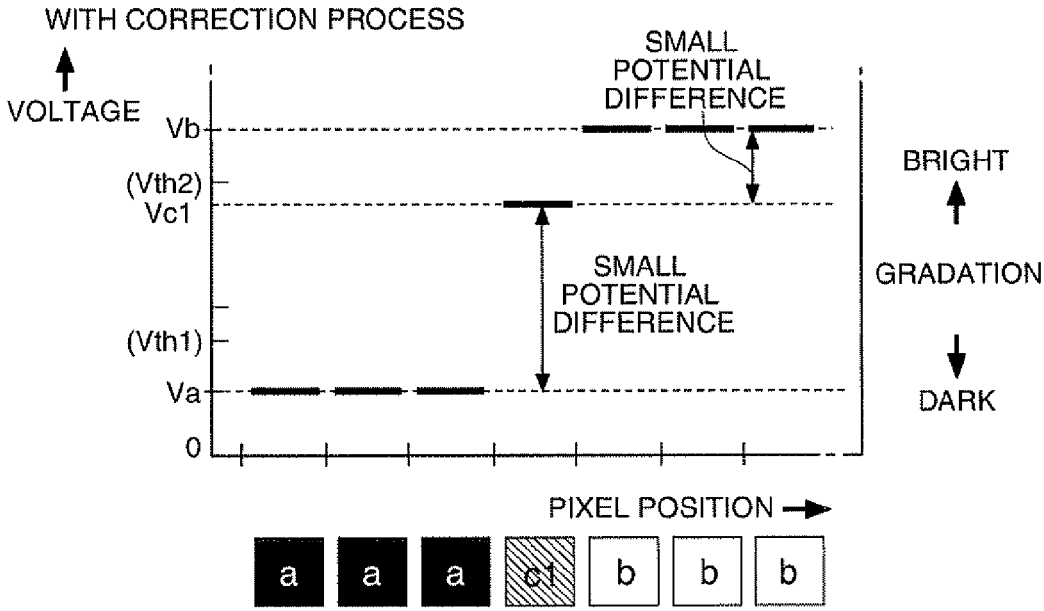

(1) APPLIED BOUNDARY DETERMINATION (2) CORRECTION PROCESS (THREE PIXELS ON HIGH POTENTIAL SIDE)

FIG. 10A <NORMALLY BLACK MODE>
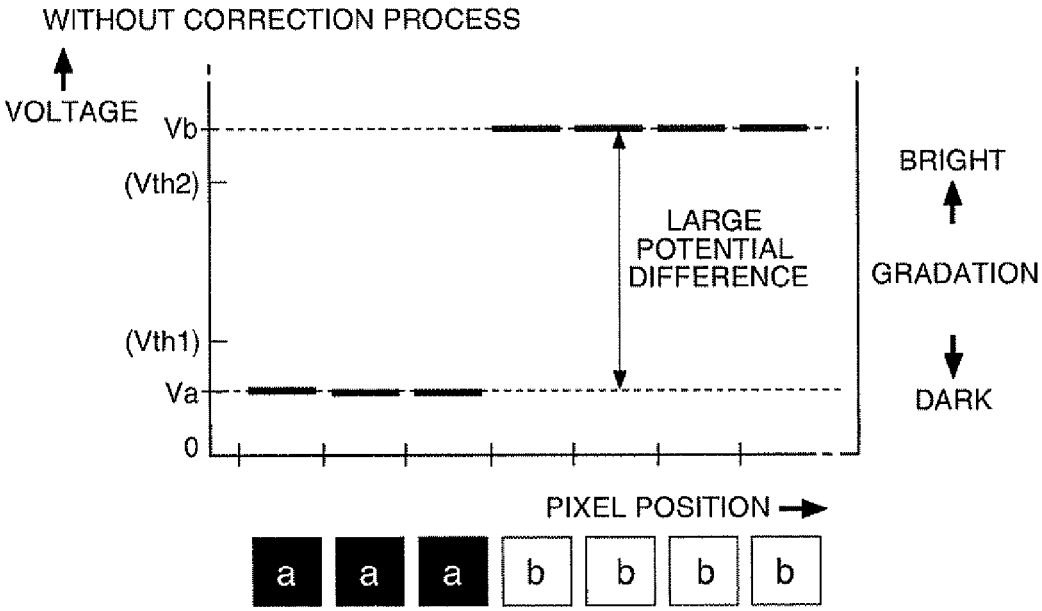
FIG. 10B
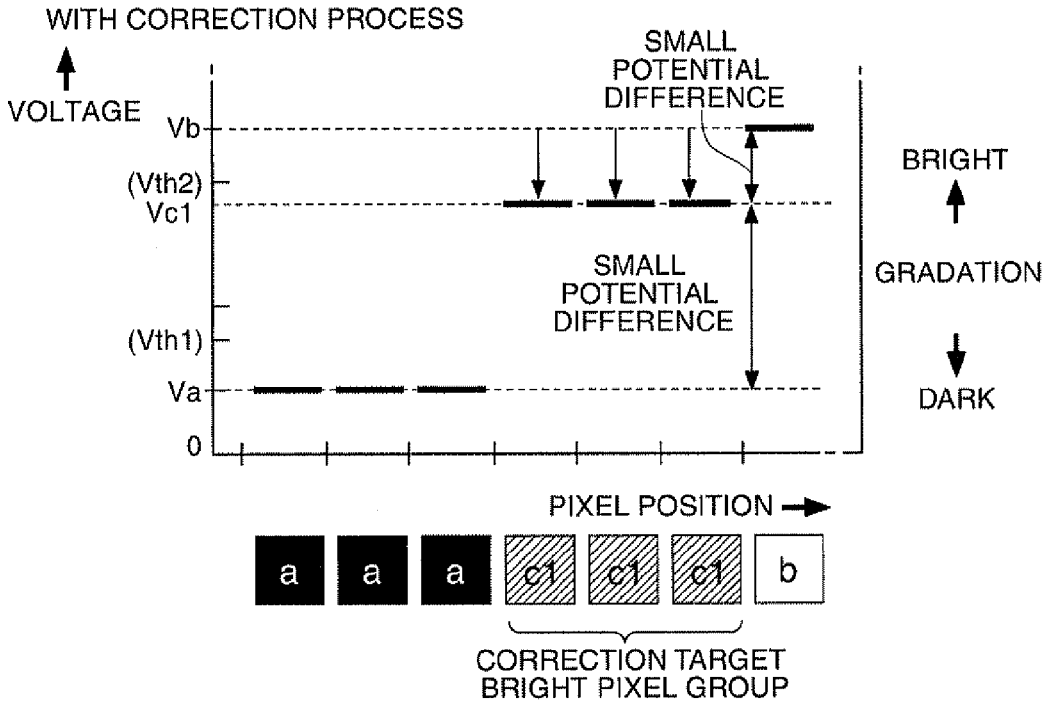

(1) APPLIED BOUNDARY DETERMINATION (2) CORRECTION PROCESS (THREE PIXELS ON HIGH POTENTIAL SIDE)

FIG. 12A <NORMALLY BLACK MODE>
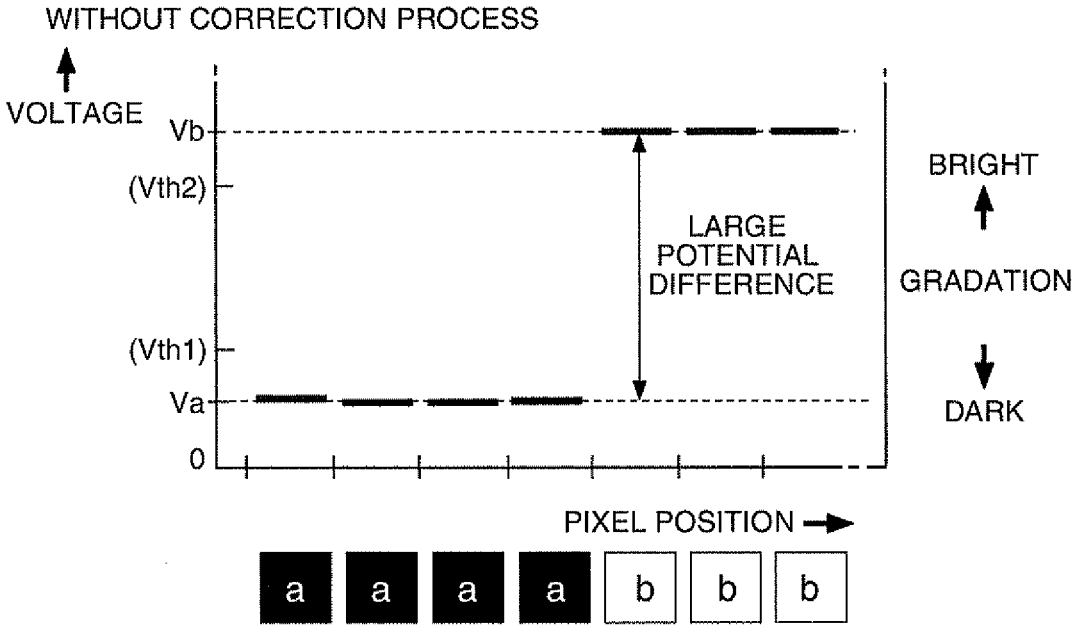
FIG. 12B
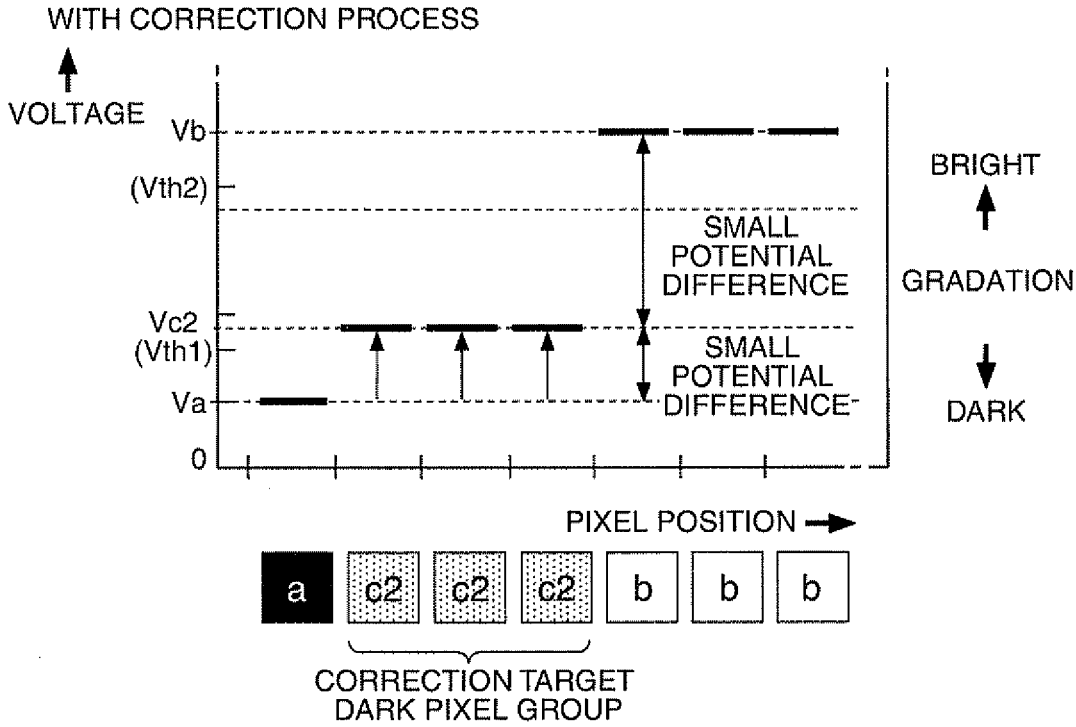

(1) APPLIED BOUNDARY DETERMINATION (2) CORRECTION PROCESS (TWO PIXELS ON HIGH POTENTIAL SIDE+TWO PIXELS ON LOW POTENTIAL SIDE)

FIG. 15A <NORMALLY BLACK MODE>
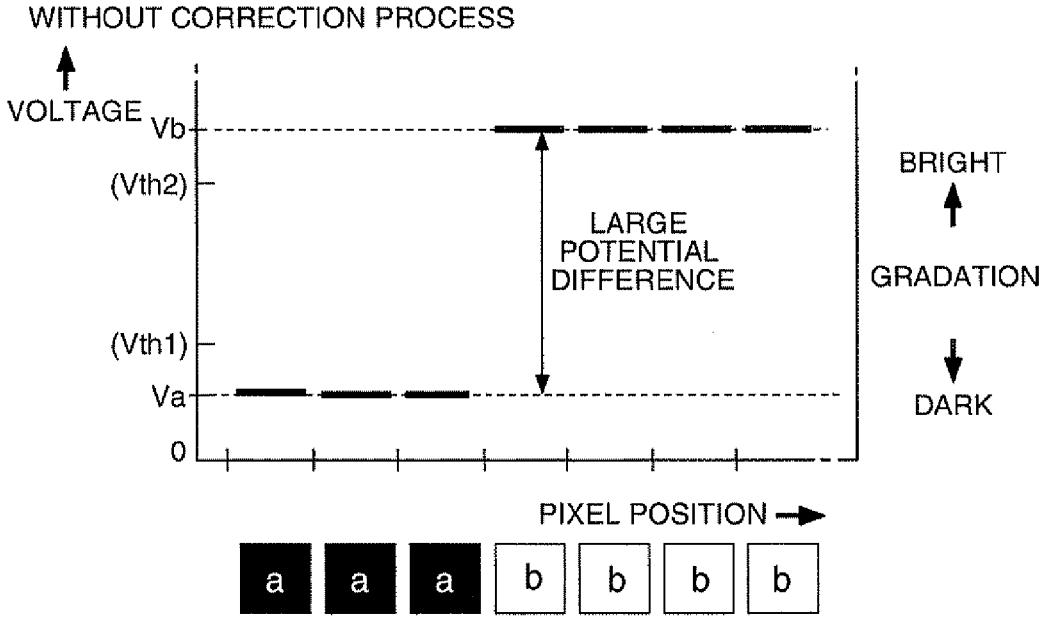
FIG. 15B
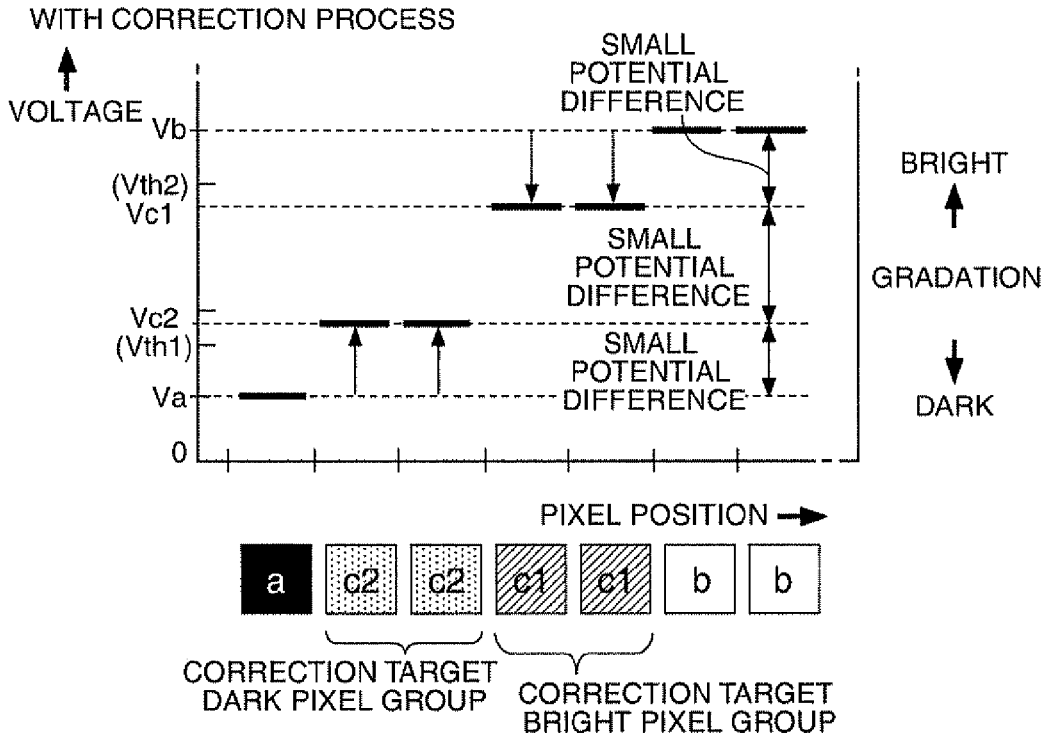

VIDEO PROCESSING CIRCUIT, VIDEO PROCESSING METHOD, LIQUID CRYSTAL DISPLAY DEVICE, AND ELECTRONIC APPARATUS

BACKGROUND

1. Technical Field

The present invention relates to a technique of reducing display defects in a liquid crystal panel.

2. Related Art

A liquid crystal panel is configured such that a liquid crystal is interposed between a pair of substrates held with a predetermined gap therebetween. Specifically, the liquid crystal panel has a configuration in which pixel electrodes are arranged in a matrix form for each pixel on one substrate, a common electrode is provided on the other substrate so as to be shared by the respective pixels, and the liquid crystal is interposed between the pixel electrodes and the common electrode. When a voltage corresponding to a gradation level is applied and held between the pixel electrode and the common electrode, the alignment state of the liquid crystal is defined for each pixel, whereby transmittance or reflectance is controlled. Therefore, in the configuration above, it can be said that among the electric field acting on the liquid crystal molecules, only a component in the direction (or the opposite direction) from the pixel electrode towards the common electrode, namely in the direction perpendicular (vertical) to the substrate surface contributes to display control.

However, as the pixel pitch has narrowed with further miniaturization and higher definition in recent years, the effect of an electric field which is generated between the adjacent pixel electrodes, namely an electric field in the direction parallel (horizontal) to the substrate surface has become unignorable. For example, when a horizontal electric field is applied to a liquid crystal that is designed to be driven by a vertical electric field such as in a VA (Vertical Alignment) or TN (Twisted Nematic)-mode liquid crystal, there is a problem in that alignment defects (namely, reverse tilt domain) occur in the liquid crystal, thus causing display defects.

Various proposals have been made in order to reduce the effect of reverse tilt domain. For example, JP-6-34965 (FIG. 1) discloses a new liquid crystal panel structure in which the shape of a light shielding layer (opening) is defined in conformity with the pixel electrode. Moreover, JP-2009-69608 (FIG. 2) discloses a technique in which when determining that reverse tilt domain occurs when an average luminance value calculated from a video signal is equal to or lower than a threshold value, video signals having a luminance value equal to or higher than a preset value are clipped away.

However, the technique of reducing the reverse tilt domain by devising a new liquid crystal panel structure has a drawback in that the aperture ratio is likely to decrease and it is difficult to apply the technique to a liquid crystal panel which is not manufactured in advance so as to have the new structure. On the other hand, the technique of clipping away the video signals having a luminance value equal to or higher than a preset value has a drawback in that the brightness of displayed images is limited to the preset value.

SUMMARY

An advantage of some aspects of the invention is that it provides a technique of reducing reverse tilt domain while solving these drawbacks.

According to an aspect of the invention, there is provided a video processing circuit used in a liquid crystal panel in which a liquid crystal is interposed between a first substrate on which a pixel electrode is provided so as to correspond to each of a plurality of pixels and a second substrate on which a common electrode is provided, and a liquid crystal device is formed of the pixel electrode, the liquid crystal, and the common electrode, the video processing circuit inputting video signals that specify an applied voltage to the liquid crystal device for each of the pixels and defining each of the applied voltages to the liquid crystal devices based on processed video signals, including: a first boundary detector that analyzes a video signal of a present frame to detect a boundary between a first pixel of which the applied voltage specified by the video signal is lower than a first voltage and a second pixel of which the applied voltage is equal to or higher than a second voltage higher than the first voltage; a second boundary detector that analyzes a video signal of a frame one frame before the present frame to detect a boundary between the first pixel and the second pixel; a correction portion that corrects an applied voltage to a liquid crystal device corresponding to a second pixel which is adjacent to a portion of the boundary detected by the first boundary detector, which is changed from the boundary detected by the second boundary detector from the applied voltage specified by the video signal of the present frame to a voltage equal to or higher than the first voltage and lower than the second voltage. According to this configuration, since it is not necessary to apply changes to the structure of a liquid crystal panel, the aperture ratio will not decrease, and the invention can be applied to a liquid crystal panel which is not manufactured in advance so as to have a new structure. Moreover, since the applied voltage to a liquid crystal device corresponding to a second pixel among the pixels adjacent to the boundary is corrected from the value corresponding to the gradation level specified by the video signal, the brightness of a displayed image is not limited to a preset value.

In the video processing circuit, it is preferable that the correction portion corrects the applied voltages to liquid crystal devices corresponding to the second pixel adjacent to the changed portion and a second pixel continuous to the second pixel to a voltage equal to or higher than the first voltage and lower than the second voltage. According to this configuration, it is possible to prevent the occurrence of reverse tilt domain even when the response time of a liquid crystal device is longer than the refresh time interval of the display screen. Specifically, when the refresh time interval of the display of the liquid crystal panel is S and the response time of the liquid crystal device when the applied voltage is changed to the correction voltage is T, if $S<T$, the number of second pixels including a second pixel adjacent to the boundary and a second pixel continuous to the second pixel may be determined by the value of an integer part of a division of the response time T by the time interval S.

In the video processing circuit, it is preferable that the correction portion corrects the applied voltages to liquid crystal devices corresponding to the first pixel adjacent to the changed portion and a first pixel continuous to the first pixel from the applied voltage specified by the video signal of the present frame to the voltage equal to or higher than the first voltage and lower than the second voltage and lower than the applied voltages to liquid crystal devices corresponding to the second pixels adjacent to the changed portion disposed therebetween a second pixel continuous to the second pixels. With this configuration, the difference in the applied voltage between the adjacent pixels is further decreased, and the occurrence of reverse tilt domain can be suppressed more effectively.

According to another aspect of the invention, there is provided a video processing circuit used in a liquid crystal panel in which a liquid crystal is interposed between a first substrate on which a pixel electrode is provided so as to correspond to each of a plurality of pixels and a second substrate on which a common electrode is provided, and a liquid crystal device is formed of the pixel electrode, the liquid crystal, and the common electrode, the video processing circuit inputting video signals that specify an applied voltage to the liquid crystal device for each of the pixels and defining each of the applied voltages to the liquid crystal devices based on processed video signals, including: a first boundary detector that analyzes a video signal of a present frame to detect a boundary between a first pixel of which the applied voltage specified by the video signal is lower than a first voltage and a second pixel of which the applied voltage is equal to or higher than a second voltage higher than the first voltage; a second boundary detector that analyzes a video signal of a frame one frame before the present frame to detect a boundary between the first pixel and the second pixel; a correction portion that corrects an applied voltage to liquid crystal devices corresponding to a first pixel which is adjacent to a portion of the boundary detected by the first boundary detector, which is changed from the boundary detected by the second boundary detector and a first pixel continuous to the first pixel from the applied voltage specified by the video signal of the present frame to a voltage equal to or higher than the first voltage and lower than the second voltage. According to this configuration, the aperture ratio will not decrease, and the invention can be applied to a liquid crystal panel which is not manufactured in advance so as to have a new structure. Moreover, since the applied voltage to a liquid crystal device corresponding to a second pixel among the pixels adjacent to the boundary is corrected from the value corresponding to the gradation level specified by the video signal, the brightness of a displayed image is not limited to a preset value. Moreover, it is possible to prevent the occurrence of reverse tilt domain even when the response time of a liquid crystal device is longer than the refresh time interval of the display screen.

In the video processing circuit, it is preferable that the correction portion corrects the applied voltage to a liquid crystal device corresponding to the first pixel continuous to the first pixel adjacent to the changed portion from the applied voltage specified by the video signal of the present frame to a voltage higher than the applied voltage to a liquid crystal device corresponding to a first pixel in which the applied voltage is not corrected and lower than the applied voltage to the first pixel adjacent to the changed portion. With this configuration, the boundary between a first pixel in which defects due to the application of a correction voltage in order to suppress the occurrence of reverse tilt domain are perceived and a first pixel which has not been subjected to correction can be made rarely visually perceived.

In the video processing circuit, it is preferable that the correction portion corrects the applied voltage to a liquid crystal device corresponding to the second pixel continuous to the second pixel adjacent to the changed portion from the applied voltage specified by the video signal of the present frame to a voltage higher than the applied voltage to a liquid crystal device corresponding to a second pixel in which the applied voltage is not corrected and lower than the applied voltage to the second pixel adjacent to the changed portion. With this configuration, the boundary between a second pixel in which defects due to the application of a correction voltage in order to suppress the occurrence of reverse tilt domain are perceived and a second pixel which was not subjected to correction can be made rarely visually perceived.

The invention can be embodied as a video processing method, a liquid crystal display device, and an electronic apparatus having the liquid crystal display device, in addition to the video processing circuit.

BRIEF DESCRIPTION OF THE DRAWINGS

The invention will be described with reference to the accompanying drawings, wherein like numbers reference like elements.

FIGS. 8A and 8B show suppression of a horizontal electric field by the correction process.

FIGS. 10A and 10B show suppression of a horizontal electric field by the correction process.

FIGS. 12A and 12B show suppression of a horizontal electric field by the correction process.

FIGS. 15A and 15B show suppression of a horizontal electric field by the correction process.

DESCRIPTION OF EXEMPLARY EMBODIMENTS

First Embodiment

First, a first embodiment of the invention will be described.

Figure 1:
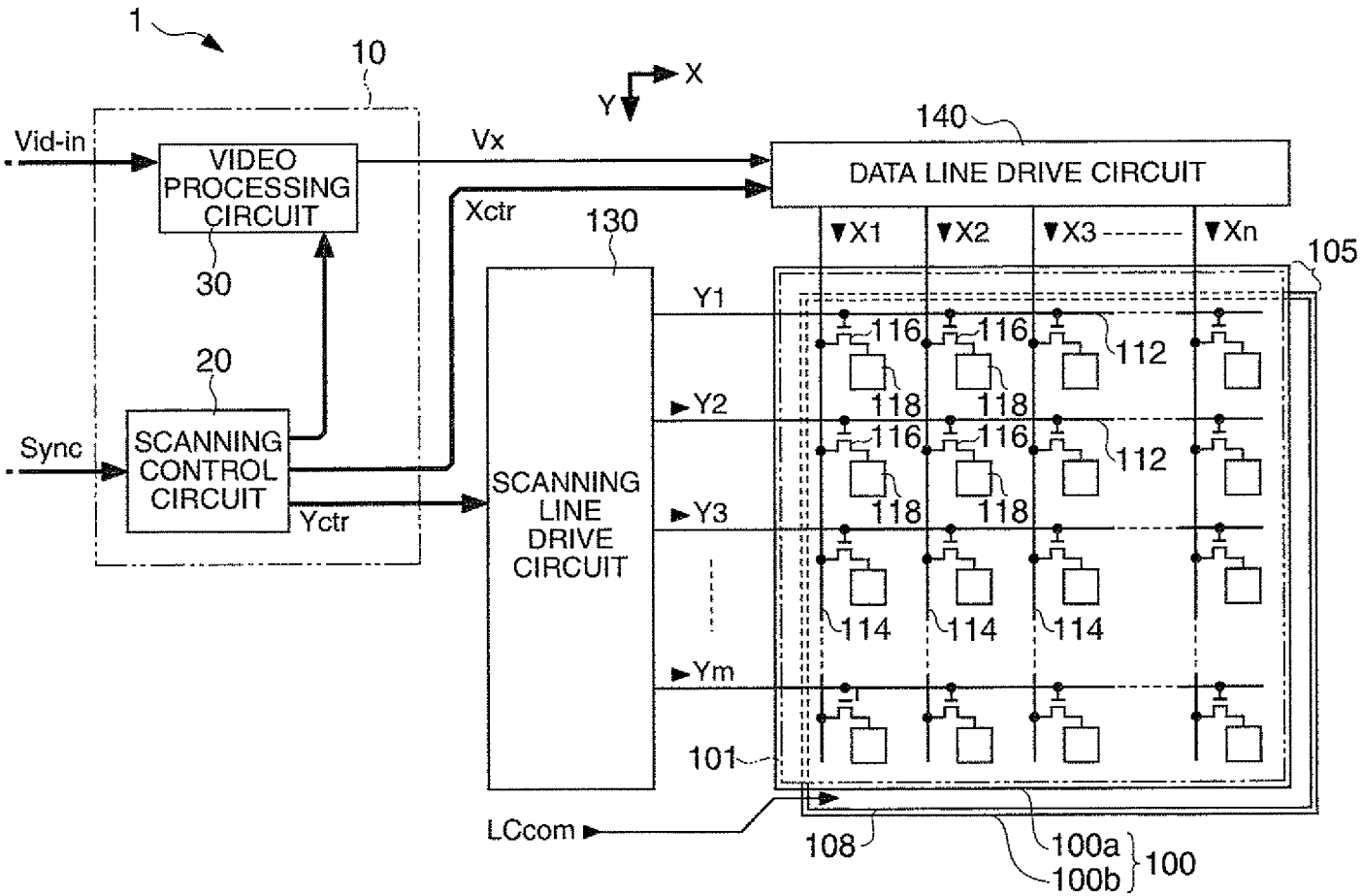
FIG. 1 shows a liquid crystal display device having a video processing circuit according to a first embodiment of the invention.

FIG. 1 is a block diagram showing an overall configuration of a liquid crystal display device having a video processing circuit according to this embodiment.

As shown in FIG. 1, a liquid crystal display device 1 includes a control circuit 10, a liquid crystal panel 100, a scanning line drive circuit 130, and a data line drive circuit 140. A video signal Vid-in is supplied from a high-order device to the control circuit 10 in synchronization with a synchronization signal Sync. The video signal Vid-in is digital data that specifies the gradation levels of the respective pixels in the liquid crystal panel 100 and is supplied in the scanning order based on the vertical/horizontal scanning signals and dot clock signal (not shown) included in the synchronization signal Sync.

Although the video signal Vid-in specifies the gradation level, since the applied voltage to a liquid crystal device is determined by the gradation level, the video signal Vid-in can be said to specify the applied voltage to the liquid crystal device.

The control circuit 10 includes a scanning control circuit 20 and a video processing circuit 30. The scanning control circuit 20 generates various control signals and controls each unit in synchronization with the synchronization signal Sync. The video processing circuit 30 processes the digital video signal Vid-in to output an analog data signal Vic, and details of which will be described later.

The liquid crystal panel 100 has a configuration in which a device substrate (first substrate) 100*a* and a counter substrate (second substrate) 100*b* are bonded together with a predetermined gap therebetween, and a liquid crystal 105 that is driven by a vertical electric field is interposed in that gap. On a surface of the device substrate 100*a* facing the counter substrate 100*b*, a plurality (m) of rows of scanning lines 112 is provided along the X (horizontal) direction in the drawing. In addition, a plurality (n) of columns of data lines 114 is provided along the Y (vertical) direction so as to be electrically insulated from the respective scanning lines 112.

In this embodiment, in order to distinguish between the scanning lines 112, they are sometimes referred to as scanning lines on the first, second, third, . . . , (m−1)-th, and m-th rows from top to bottom in the drawing. Similarly, in order to distinguish between the data lines 114, they are sometimes referred to as data lines on the first, second, third, . . . , (n−1)-th, and n-th columns from left to right in the drawing.

On the device substrate 100*a*, an n-channel TFT 116 and a rectangular transparent pixel electrode 118 are further provided in pair so as to correspond to each intersection between the scanning lines 112 and the data lines 114. The TFT 116 has a gate electrode connected to the scanning line 112, a source electrode connected to the data line 114, and a drain electrode connected to the pixel electrode 118. On the other hand, on a surface of the counter substrate 100*b* facing the device substrate 100*a*, a transparent common electrode 108 is provided over the entire surface. A voltage LCcom is applied from a circuit (not shown) to the common electrode 108.

In FIG. 1, the facing surface of the device substrate 100*a* is on the rear side of the drawing sheet. Thus, although the scanning lines 112, data lines 114, TFTs 116, and pixel electrodes 118 provided on the facing surface should be depicted by broken lines, they are intentionally depicted by solid lines to make them easy to see.

Figure 2:
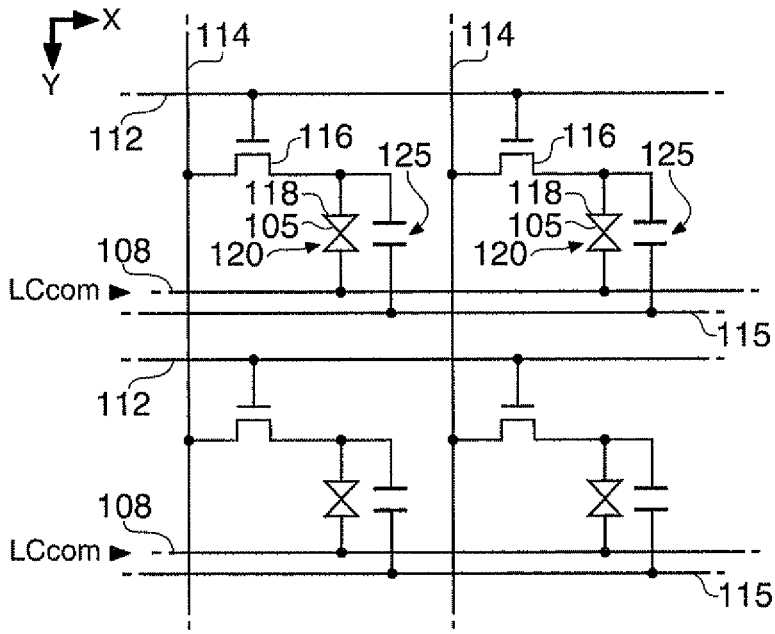
FIG. 2 shows an equivalent circuit of a liquid crystal device in the liquid crystal display device.

FIG. 2 shows an equivalent circuit of the liquid crystal panel 100.

As shown in FIG. 2, the liquid crystal panel 100 has a configuration in which liquid crystal devices 120 having the liquid crystal 105 interposed between the pixel electrode 118 and the common electrode 108 are arranged so as to correspond to intersections of the scanning lines 112 and the data lines 114. Although not shown in FIG. 1, in the equivalent circuit of the liquid crystal panel 100, actually, as shown in FIG. 2, an auxiliary capacitor (storage capacitor) 125 is provided in parallel to the liquid crystal device 120. The auxiliary capacitor 125 has one end connected to the pixel electrodes 118 and the other end connected in common to a capacitor line 115. The capacitor line 115 is held at a voltage that is constant at all times.

Here, when the scanning line 112 is in the H level, the TFTs 116 having the gate electrodes connected to the scanning line are turned ON, and the pixel electrodes 118 are connected to the data lines 114. Therefore, when the scanning line 112 is in the H level, and a data signal having a voltage corresponding to a gradation is supplied to the data lines 114, the data signal is applied to the pixel electrodes 118 through the TFTs 116 in the ON state. When the scanning line 112 is in the L level, the TFTs 116 are turned Off, and the voltage applied to the pixel electrodes 118 is held by the capacitive auxiliary capacitors 125 of the liquid crystal device 120.

In the liquid crystal device 120, the alignment state of the molecules of the liquid crystal 105 is changed in accordance with an electric field generated by the pixel electrode 118 and the common electrode 108. Therefore, when the liquid crystal device 120 is a transmission-type liquid crystal device, the transmittance thereof changes with the applied and held voltage. In the liquid crystal panel 100, since the transmittance changes for each liquid crystal device 120, the liquid crystal device 120 corresponds to a pixel. Moreover, an arrangement region of the pixels forms a display region 101.

In this embodiment, it is assumed that the liquid crystal 105 operates in the VA mode, and the liquid crystal device 120 operates in the normally black mode wherein it appears black when no voltage is applied.

Figure 5A:
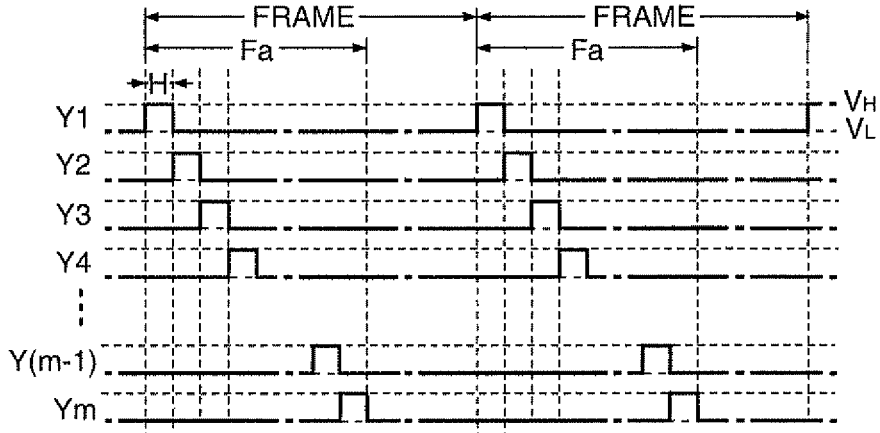
FIGS. 5A and 5B show a display operation in the liquid crystal display device.

The scanning line drive circuit 130 supplies scanning signals Y1, Y2, Y3, . . . , and Ym to the scanning lines 112 on the first, second, third, . . . , and m-th rows in accordance with a control signal Yctr from the scanning control circuit 20. Specifically, as shown in FIG. 5A, the scanning line drive circuit 130 sequentially selects the scanning lines 112 in the order of the first, second, third, . . . , (m−1) th, and m-th rows over one frame and puts the scanning signal to be supplied to the selected scanning line into a select voltage $V_H$ (H level) and the scanning line to be supplied to the other scanning lines into a non-selective voltage $V_L$ (L level).

Here, the frame refers to a period of time needed for one page of images to be displayed by the driving of the liquid crystal panel 100. If the frequency of a vertical scanning signal included in the synchronization signal Sync is 60 Hz, the frame corresponds to a period of 16.7 msec which is the inverse of that frequency.

The data line drive circuit 140 samples the data signal Vx supplied from the video processing circuit 30 in accordance with the control signal Xctr from the scanning control circuit 20 and outputs the sampled data signal to the data lines 114 on the first to n-th columns as data signals X1 to Xn.

In this specification, with regard to all voltages except the applied voltage to the liquid crystal device 120, the ground potential (not shown) is used as the reference of a zero voltage unless stated otherwise. This is to distinguish the applied voltage to the liquid crystal device 120 from other voltages, and the applied voltage to the liquid crystal device 120 is a potential difference between the voltage LCcom of the common electrode 108 and the voltage of the pixel electrode 118.

Figure 4A:
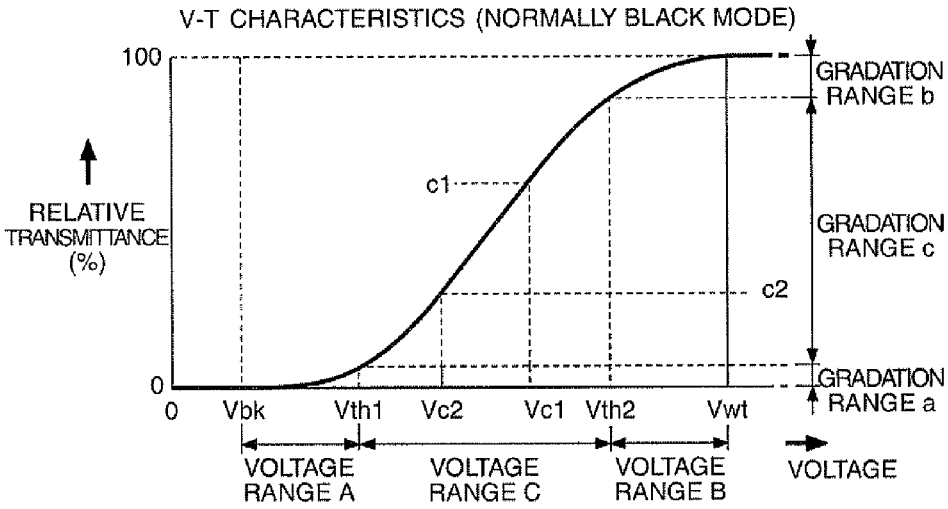
FIGS. 4A and 4B show display characteristics of the liquid crystal display device.

The relationship between the applied voltage and the transmittance of the liquid crystal device 120 of the normally black mode is represented by the V-T characteristics as shown in FIG. 4A, for example. Therefore, for the liquid crystal device 120 to have transmittance corresponding to a gradation level specified by the video signal Vid-in, it may be beneficial to apply a voltage corresponding to that gradation level to the liquid crystal device 120. However, if the applied voltage to the liquid crystal device 120 is defined by only the gradation level specified by the video signal Vid-in, display defects resulting from reverse tilt domain may occur.

The defects are considered as one of the causes as to why it is difficult for the interposed liquid crystal molecules in the liquid crystal device 120 to have an alignment state corresponding to an applied voltage when the liquid crystal molecules being in an unstable state are disordered by the effect of a horizontal electric field. When the applied voltage to the liquid crystal device 120 is equal to or higher than a voltage Vbk corresponding to the black level in the normally black mode and is in a voltage range A lower than a threshold voltage Vth1 (first voltage), the alignment regulating force of the vertical electric field is slightly stronger than the alignment regulating force by the alignment film. Thus, the alignment state of the liquid crystal molecules is easily disordered. This is when the liquid crystal molecules are in the unstable state. For the sake of convenience, a transmittance range (gradation range) of the liquid crystal device in which the applied voltage is in the voltage range A will be denoted as "a". In the following description, the gradation levels in the gradation range a will be referred to as "a" when it is not necessary to distinguish the respective gradation levels, and the applied voltage to the liquid crystal device 120 to obtain the gradation level a will be referred to as "Va.".

Here, the case where the liquid crystal molecules are affected by the horizontal electric field is when the potential difference between the adjacent pixel electrodes increases, which is a case where dark pixels having a black level or a level close to the black level and bright pixels having a white level or a level close to the white level are adjacent in an image that is to be displayed. Among these pixels, the dark pixels are the liquid crystal devices 120 in which the applied voltage is in the voltage range A in the normally black mode as shown in FIG. 4A, and bright pixel apply a horizontal electric field to the dark pixels. To specify such bright pixels, it is assumed that the bright pixels are the liquid crystal devices 120 in which the applied voltage is equal to or higher than the threshold voltage Vth2 (second voltage) and is in the voltage range B equal to or lower than a voltage Vwt corresponding to the white level in the normally black mode. Moreover, for the sake of convenience, a transmittance range (gradation range) of the liquid crystal device 120 in which the applied voltage is in the voltage range B will be denoted as "b". In the following description, the gradation levels in the gradation range b will be referred to as "b" when it is not necessary to distinguish the respective gradation levels, and the applied voltage to the liquid crystal device 120 to obtain the gradation level b will be referred to as "Vb".

In the normally black mode, the threshold voltage Vth1 may be considered as an optical threshold voltage when the relative transmittance of a liquid crystal device is 10%, and the threshold voltage Vth2 may be considered as an optical saturation voltage when the relative transmittance of a liquid crystal device is 90%.

A liquid crystal device in which the applied voltage is in the voltage range A is in a state where reverse tilt domain can easily occur by the effect of a horizontal electric field when it is adjacent to a liquid crystal device in which the applied voltage is in the voltage range B. In other words, the liquid crystal device in the voltage range B is in a stable state in which, because the effect of a vertical electric field is dominant even when it is adjacent to the liquid crystal device in the voltage range A. Thus, reverse tilt domain will not occur unlike the liquid crystal device in the voltage range A.

Figure 20:
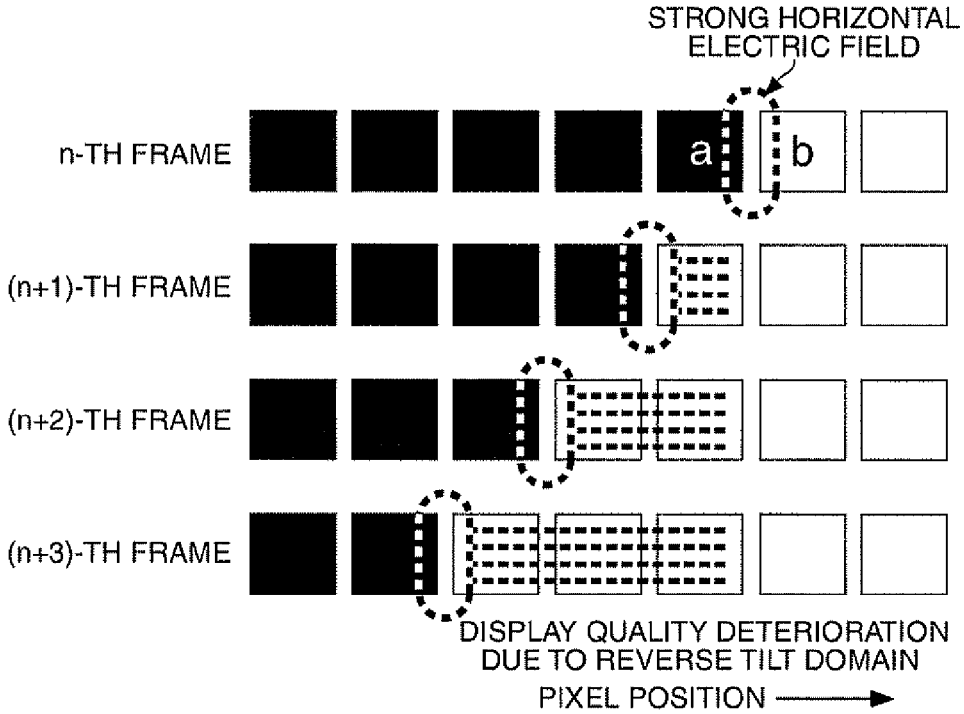
FIG. 20 shows display defects due to the effect of a horizontal electric field.

An example of display defects resulting from reverse tilt domain will be described. For example, a case where the image represented by the video signal Vid-in is as shown in FIG. 20, specifically dark pixels in the gradation range a move on the background bright pixels in the gradation range b the leftward direction by a distance of one pixel for each frame will be considered. In this case, a kind of trailing phenomenon occurs. That is, a pixel which is to be changed from a dark pixel to a bright pixel does not have a gradation in the gradation range b due to the occurrence of reverse tilt domain. One of the causes of this phenomenon is the strong horizontal electric field between a dark pixel and a bright pixel when these pixels are adjacent. The strong horizontal electric field disorders the alignment of the liquid crystal molecules in the dark pixel, and the alignment disordered region broadens with the movement of the dark pixel.

Therefore, in order to suppress the occurrence of display defects resulting from the alignment disorder of the liquid crystal molecules, it is important to ensure that, even when a dark pixel and a bright pixel are adjacent in the image represented by the video signal Vid-in, a dark pixel and a bright pixel are not adjacent in the liquid crystal panel 100.

Therefore, the video processing circuit 30 on the front stage of the liquid crystal panel 100 analyzes the image represented by the video signal Vid-in to detect whether or not dark pixels in the gradation range a and bright pixels in the gradation range b are adjacent. Then, the video processing circuit 30 corrects (substitutes) the gradation levels of a bright pixel adjacent to the boundary of dark pixels and bright pixels and two or more bright pixels (namely, pixels in which the applied voltage is to be increased) continuous in the direction away from the boundary to a gradation level c1 in a gradation range c different from the gradation range b and the gradation range a. The gradation range c is the range of gradation levels higher than the gradation range a and lower than the gradation range b. In this way, in the liquid crystal panel 100, a voltage Vc1 corresponding to the gradation level c1 is applied to the liquid crystal devices 120 corresponding to the bright pixels. Thus, a strong horizontal electric field is not generated in pixels (dark pixels in the normally black mode) which are easily affected by the horizontal electric field.

In the case of images which involve movement, it may be, or may not be necessary to correct the gradation level of a pixel that is adjacent to the boundary in the present frame represented by the video signal Vid-in if the movement of an image including a frame (namely, the previous frame) occurring one frame earlier than the present frame is taken into consideration. This invention suppresses the occurrence of reverse tilt domain considering the state of the previous frame at the time of making correction of the present frame.

Figure 3:
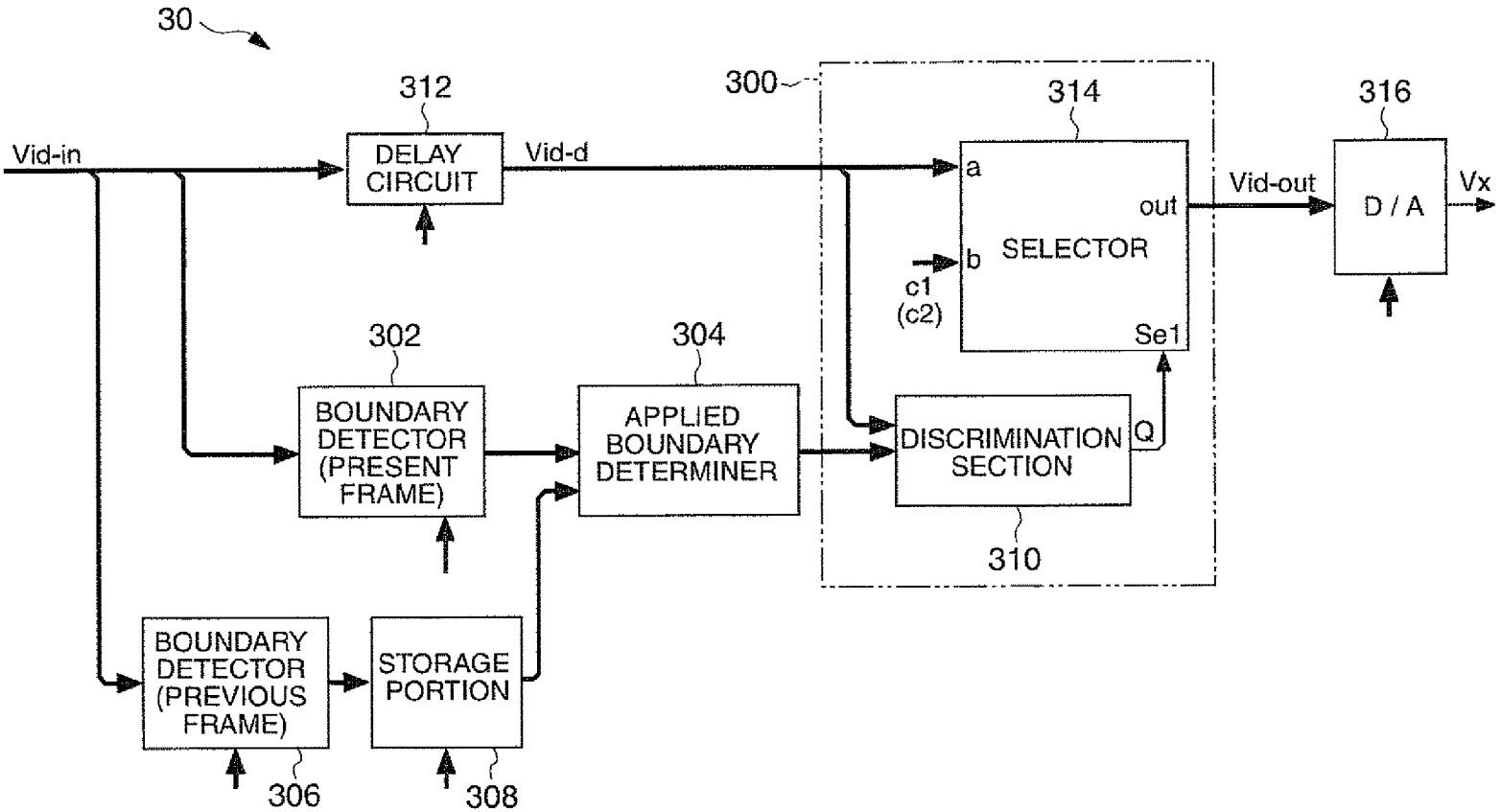
FIG. 3 shows a configuration of the video processing circuit.

Next, the details of the video processing circuit 30 will be described with reference to FIG. 3. As shown in FIG. 3, the video processing circuit 30 includes a correction portion 300, a boundary detector 302, an applied boundary determiner 304, a boundary detector 306, a storage portion 308, a delay circuit 312, and a D/A converter 316.

The delay circuit 312 is configured by a FIFO (Fast In Fast Out) memory or a multi-stage latch circuit and is configured to store the video signal Vid-in supplied from the high-order device and read out the video signal after the passage of a predetermined period to be output as a video signal Vid-d. The storage and readout operations in the delay circuit 312 are controlled by the scanning control circuit 20.

The boundary detector 302 analyzes an image represented by the video signal Vid-in so as to determine whether or not there is a portion where a pixel (first pixel) in the gradation range a and a pixel (second pixel) in the gradation range b are adjacent. When the adjacent portion is determined to be present, the boundary detector 302 detects the adjacent portion as a boundary. The boundary detector 302 corresponds to a first boundary detector.

The boundary as used therein merely refers to a portion where a pixel in the gradation range a and a pixel in the gradation range b are adjacent. Therefore, for example, a portion where a pixel in the gradation range a and a pixel in a different gradation range c are adjacent, and a portion where a pixel in the gradation range b and a pixel in the gradation range c are adjacent are not treated as the boundary.

The boundary detector 306 analyzes an image represented by the video signal Vid-in of the previous frame to detect a portion where a pixel in the gradation range a and a pixel in the gradation range b are adjacent as the boundary. Here, the same definition as used for the boundary detector 302 applies to the boundary detected by the boundary detector 306.

The storage portion 308 stores the information on the boundary detected by the boundary detector 306 and outputs the information with a delay of one frame period.

Therefore, the boundary detected by the boundary detector 302 is associated with the present frame, whereas the boundary detected by the boundary detector 306 and stored in the storage portion 308 is associated with the frame occurring one frame before the present frame. Thus, the boundary detector 306 corresponds to a second boundary detector.

The applied boundary determiner 304 determines a portion (the changed boundary portion) obtained by excluding the same portion as the boundary of the previous frame image stored in the storage portion 308 from the boundary of the present frame image detected by the boundary detector 306 as an applied boundary.

The correction portion 300 includes a determination portion 310 and a selector 314. The determination portion 310 determines whether or not the gradation level of the pixel represented by the video signal. Vid-d delayed by the delay circuit 312 belongs to the gradation range b and whether or not the pixel is adjacent to the boundary detected by the boundary detector 302. The determination portion 310 sets the output signal flag Q, for example, to "1" if all the determination results are "Yes" and sets the flag Q to "0" if any one of the determination results is "No".

The boundary detector 302 is unable to detect the boundary in an image that is to be displayed unless at least a plurality of video signals are stored. Therefore, the delay circuit 312 is provided so as to adjust the timings at which the video signal Vid-in is supplied. Therefore, since the timings of the video signal Vid-in are different from the timings of the video signal Vid-d supplied from the delay circuit 312, strictly speaking, the horizontal scanning periods or the like of the two signals are not identical. However, in the following description, such periods will not be distinguished.

The determination portion 310 determines whether or not the gradation level of the pixel represented by the delayed video signal Vid-d belongs to the gradation range a and whether or not the pixel is adjacent to the applied boundary determined by the applied boundary determiner 304. The determination portion 310 sets the output signal flag Q, for example, to "1" if all the determination results are "Yes" and sets the flag Q to "0" if any one of the determination results is "No".

In this configuration, if the flag Q is "1," it means that the pixel represented by the delayed video signal Vid-d belongs to the gradation range a and is adjacent to the boundary in the present frame but is not adjacent to the boundary in the frame one frame before the present frame. Since the selector 314 selects an input terminal b if the flag Q is "1," the video signal Vid-d of the present frame is corrected to a video signal that specifies the gradation level c1 and output as the video signal Vid-out.

On the other hand, if the flag Q is "0," it means that the pixel represented by the delayed video signal Vid-d (a) does not belong to the gradation range a but (b) belongs to the gradation range a and is either adjacent to the boundary in the present frame or is also adjacent to the boundary in the frame one frame before the present frame. Thus, if the flag Q is "0," the video signal Vid-d supplied to an input terminal a is output as the video signal Vid-out.

The selector 314 selects one of the input terminals a and b in accordance with the flag Q supplied to a control terminal Sel and outputs the signal supplied to the selected input terminal as the video signal Vid-out through an output terminal Out. Specifically, in the selector 314, the video signal Vid-d from the delay circuit 312 is supplied to the input terminal a, and a correction video signal having the gradation level c1 is supplied to the input terminal b. The selector 314 selects the input terminal b if the flag Q supplied to the control terminal Sel is "1" and selects the video signal Vid-d supplied to the input terminal a if the flag Q is "0" and outputs either one of the video signals as the video signal Vid-out.

Note that the symbol (c2) included in FIG. 3 is not related to this embodiment.

The D/A converter 316 converts the video signal Vid-out which is digital data to an analog data signal Vx. In order to prevent a DC component from being applied to the liquid crystal 105, the voltage of the data signal Vx is alternately changed every frame between a positive-polarity voltage on the high potential side with respect to the voltage Vc which is the center of the video signal amplitude and a negative-polarity voltage on the low potential side.

Although the voltage LCcom applied to the common electrode 108 may be considered to be approximately the same voltage as the voltage Vc, the voltage LCcom is sometimes adjusted so as to be lower than the voltage Vc considering the OFF leakage or the like of the n-channel TFT 116.

In the configuration described above, if the flag Q is "1," it means that the pixel represented by the video signal Vid-in belongs to the gradation range b and is adjacent to the boundary in the present frame but is not adjacent to the boundary in the frame one frame before the present frame. That is, if the flag Q is "1," it means that dark pixels adjacent to the boundary disposed therebetween are affected by the horizontal electric field and reverse tilt domain is likely to occur therein. Since the selector 314 selects an input terminal b if the flag Q is "1," the video signal Vcid-d that specifies the gradation level in the gradation range b is corrected to a video signal that specifies the gradation level c1 and output as the video signal Vid-out. On the other hand, since the selector 314 selects the input terminal a if the flag Q is "0," the delayed video signal Vid-d is output as the video signal Vid-out.

Next, a display operation of the liquid crystal display device 1 will be described. The video signals Vid-in are sequentially supplied from the high-order device in one frame in the order of the positions (row, column) of the pixels, that is, the pixels on the positions (1,1) to (1,n), (2,1) to (2,n), (3,1) to (3,n), . . . , and (m,1) to (m,n). The video processing circuit 30 performs processing (for example delaying, correction, and the like) on the video signal Vid-in and output the processed video signal as the video signal Vid-out.

Figure 5B:
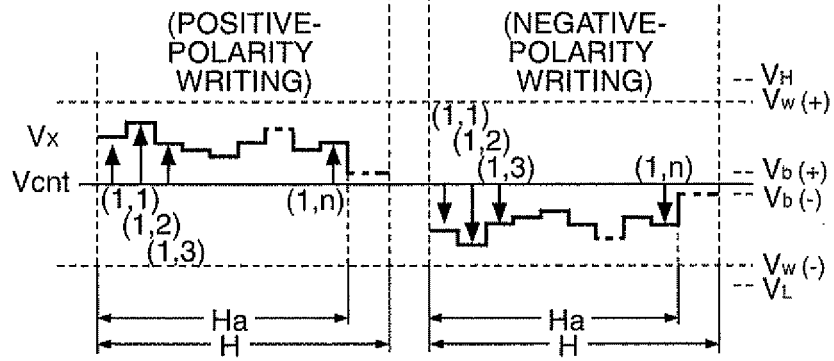

Here, in an effective horizontal scanning period (Ha) when the video signal Vid-out of the pixels on the row and column positions (1,1) to (1,n) is output, the processed video signal Vid-out is converted to a positive or negative data signal Vx (in this example, a positive data signal) by the D/A converter 316 as shown in FIG. 5B. The data signal Vx is sampled by the data line drive circuit 140 and output to the data lines 114 on the first to n-th columns as data signals X1 to Xn.

On the other hand, in a horizontal scanning period when the video signal Vid-out of the pixels on the row and column positions (1,1) to (1,n) is output, the scanning control circuit 20 causes the scanning line drive circuit 130 to set only the scanning signal Y1 to be in the H level. When the scanning signal. Y1 is in the H level, since the TFTs 116 on the first row are turned ON, the data signals sampled in the data lines 114 are applied to the pixel electrodes 118 through the TFTs 116 in the ON state. In this way, a positive-polarity voltage corresponding to a gradation level specified by the video signal Vid-out is written to each of the liquid crystal devices on the row and column positions (1,1) to (1,n).

Subsequently, the video signal Vid-in of the pixels on the row and column positions (2,1) to (2,n) is similarly processed by the video processing circuit 30 and output as the video signal Vid-out. The video signal Vid-out is converted to a positive data signal by the D/A converter 316 and sampled by the data line drive circuit 140 and output to the data lines 114 on the first to n-th columns.

In the horizontal scanning period when the video signal Vid-out of the pixels on the row and column positions (2,1) to (2,n) is output, since the scanning line drive circuit 130 causes only the scanning signal Y2 to be in the H level, the data signals sampled in the data lines 114 are applied to the pixel electrodes 118 through the TFTs 116 which are on the second row and in the ON state. In this way, a positive-polarity voltage corresponding to a gradation level specified by the video signal Vid-out is written to each of the liquid crystal devices on the row and column positions (2,1) to (2,n).

Thereafter, the same writing operation is executed on the pixels on the third, fourth, . . . , and m-th rows, whereby a voltage corresponding to a gradation level specified by the video signal Vid-out is written to the respective liquid crystal devices, and a transmission image defined by the video signal Vid-in is created.

In the subsequent frame, the same write operation is executed, except that the polarity of the data signal is inverted so that the video signal Vid-out is converted to a negative data signal.

FIG. 5B is a voltage waveform diagram showing an example of the data signal Vx when the video signal Vid-out of the pixels on the row and column positions (1,1) to (1,n) is output from the video processing circuit 30 over one horizontal scanning period (H). Since this embodiment uses the normally black mode, a positive data signal Vx has a voltage (depicted by an upper arrow ↑ in the drawing) on the higher side than the reference voltage Vcnt by an amount corresponding to the gradation level processed by the video processing circuit 30, whereas a negative data signal Vx has a voltage (depicted by a downward arrow ↓ in the drawing) on the lower side than the reference voltage Vcnt by an amount corresponding to the gradation level.

Specifically, the positive data signal Vx has a voltage that is shifted from the reference voltage Vcnt by an amount corresponding to the gradation within the range from the voltage Vw(+) corresponding to white to the voltage Vb(+) corresponding to black. On the other hand, the negative data signal Vx has a voltage that is shifted from the reference voltage Vcnt by an amount corresponding to the gradation within the range from the voltage Vw(−) corresponding to white to the voltage Vb(−) corresponding to black.

The voltages Vw(+) and Vw(−) are symmetrical to each other with respect to the voltage Vcnt. The voltages Vb(+) and Vb(−) are symmetrical to each other with respect to the voltage Vcnt.

FIG. 5B shows the voltage waveform of the data signal Vx, which is different from the voltage (the potential difference between the pixel electrode 118 and the common electrode 108) applied to the liquid crystal device 120. Moreover, the vertical scale of the data signal voltage in FIG. 5B is enlarged as compared to the voltage waveform of the scanning signal or the like in FIG. 5A.

A specific example of a correction process by the video processing circuit 30 will be described.

Figure 6:
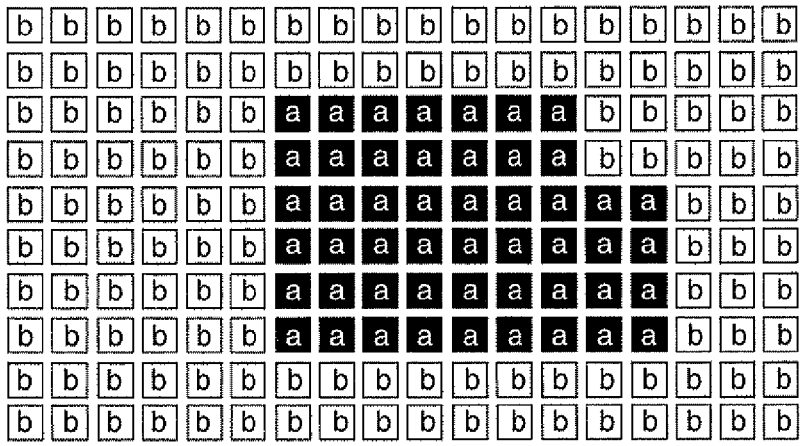
FIG. 6 shows the details of a correction process in the video processing circuit.
Figure 6:
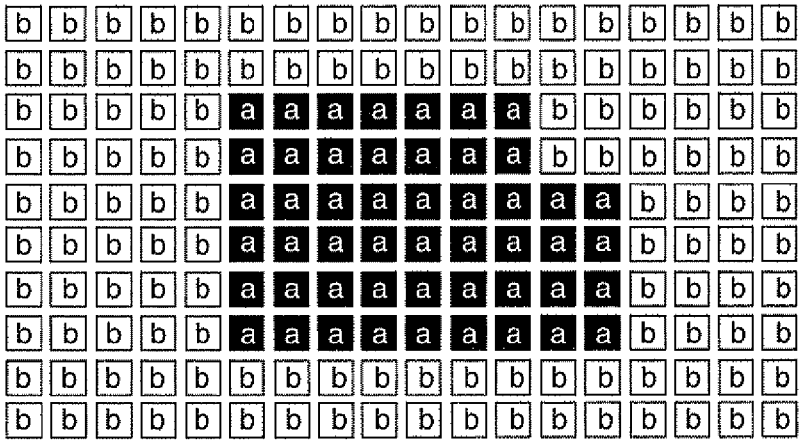
Figure 6:
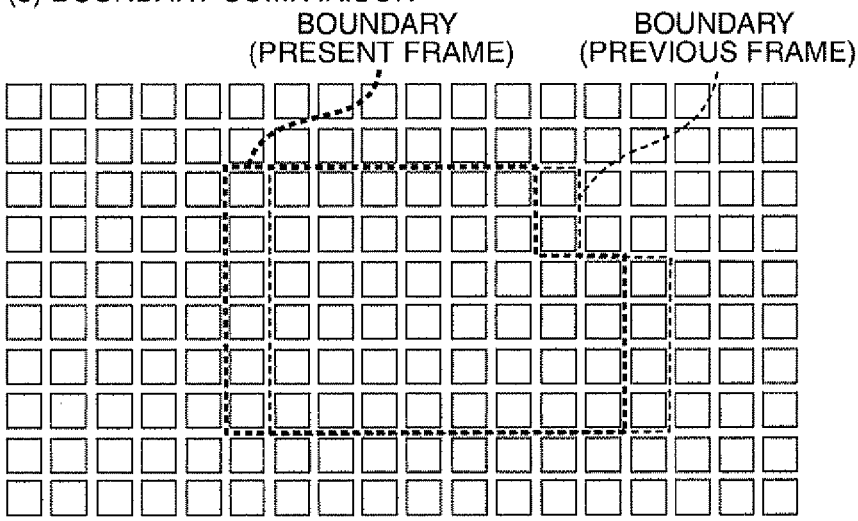

A case where an image represented by the video signal Vid-in of a frame occurring one frame earlier than the present frame is as shown in part (1) in FIG. 6, for example, and an image represented by the video signal Vid-in of the present frame is as shown in (2) in FIG. 6, for example, namely, a pattern made up of dark pixels in the gradation range a moves on the background bright pixels in the gradation range b in the leftward direction will be considered. In this case, a boundary in the previous frame image detected by the boundary detector 306 and stored in the storage portion 308 and a boundary in the present frame image detected by the boundary detector 302 will be as shown in part (3) in FIG. 6.

Figure 7:
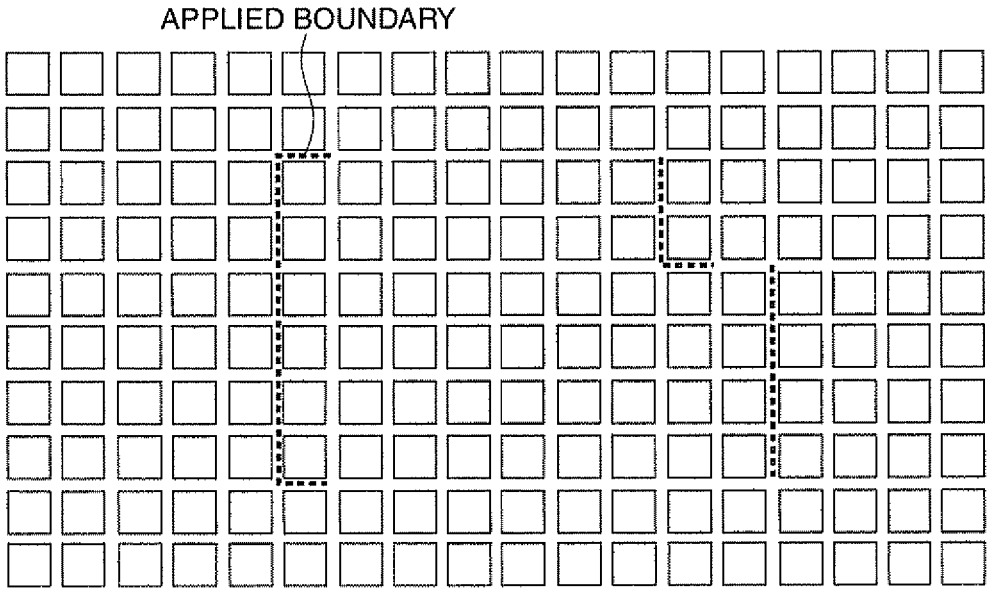
FIG. 7 shows the details of a correction process in the video processing circuit.
Figure 7:
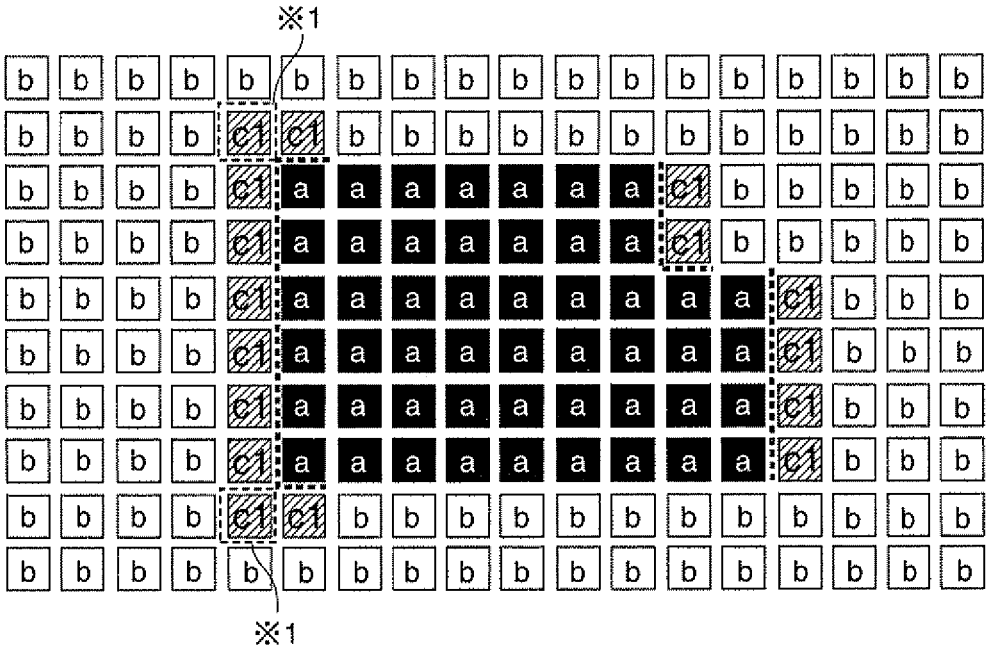

Therefore, the applied boundary determined by the applied boundary determiner 304 will be as shown in part (4) in FIG. 7.

In the video processing circuit 30, the video signal is corrected so that a bright pixel which is adjacent to a portion (namely, the applied boundary) of the boundary in the present frame between a dark pixel of which the gradation level belongs to the gradation range a and a bright pixel of which the gradation level belongs to the gradation range b and which is changed from the boundary in the previous frame has the gradation level c1 and the corrected video signal is output as the video signal Vid-out. Therefore, an image shown in part (2) in FIG. 6 is corrected to the image having the gradation level as shown in part (5) in FIG. 7 by the video processing circuit 30. Although the gradation level c1 is obtained from any one of the applied voltages (third voltage) that are equal to the threshold voltage Vth1 and lower than the threshold voltage Vth2, it is preferable that the gradation level c1 falls within 10% changes from the luminance when no correction is performed.

In a configuration in which the video signal Vid-in is supplied to the liquid crystal panel 100 without being processed by the video processing circuit 30, in the case of positive-polarity writing, the potential of the pixel electrode is as shown in FIG. 8A, for example. That is, although the potential of the pixel electrode of a bright pixel is lower than the potential of the pixel electrode of a dark pixel in the case of positive-polarity writing, since the potential difference thereof is large, the pixels are easily affected by the horizontal electric field. On the other hand, in the case of negative-polarity writing, although the potentials are symmetrical about the voltage Vc (approximately the same as the voltage LCcom) and the magnitude relationship thereof is reversed, since the potential difference thereof is still large, the pixels are easily affected by the horizontal electric field.

In contrast, according to the configuration of the video processing circuit 30, when the display of FIG. 8A is specified by the video signal Vid-in, the potential of the pixel electrode is pulled up as shown in FIG. 8B. In this way, since the potential difference between the pixel electrodes is changed stepwise, it is possible to suppress the effect of the horizontal electric field. As a result, even when a dark pixel in the gradation range a moves on the background bright pixels in the gradation range b in the leftward direction by a distance of one pixel for each frame, since the occurrence of reverse tilt domain is suppressed, the occurrence of a trailing phenomenon as shown in FIG. 20 is not noticeable.

Figure 4B:
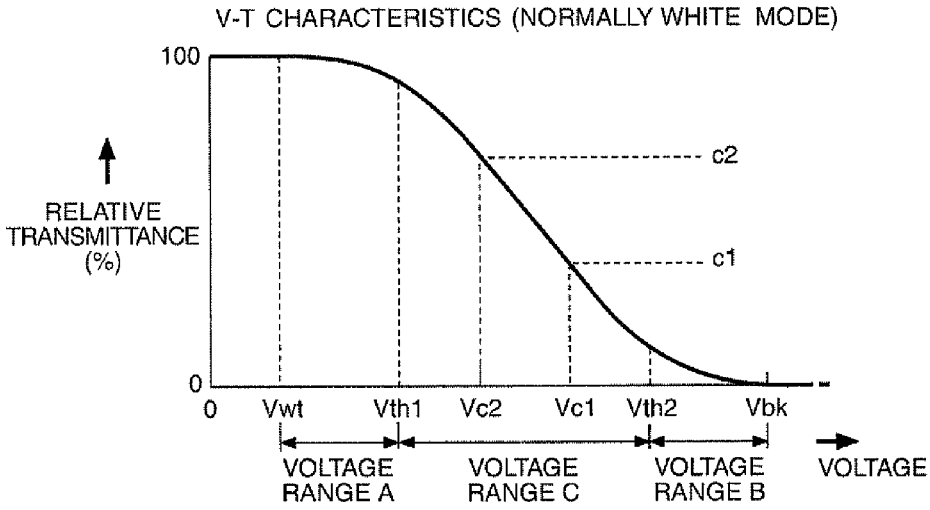

In this embodiment, although the liquid crystal 105 is a VA-mode liquid crystal operating in the normally black mode, the liquid crystal 105 may be a TN-mode liquid crystal, for example and the liquid crystal device 120 may operate in a normally white mode wherein it appears white when no voltage is applied. When the liquid crystal 105 operates in the normally white mode, the relationship between the applied voltage and the transmittance of the liquid crystal device 120 is represented by the V-T characteristics as shown in FIG. 4B. That is, the transmittance decreases as the applied voltage increases. Although the pixels that are affected by the horizontal electric field are pixels in which the applied voltage is low, in the normally white mode, the pixels in which the applied voltage is low are bright pixels. Therefore, in the normally white mode, it may be beneficial to configure the video processing circuit 30 to perform a process wherein, when a bright pixel (first pixel) having a transmittance higher than that when the applied voltage is the threshold voltage Vth1 and a dark pixel (second pixel) having a transmittance equal to or lower than that when the applied voltage is the threshold voltage Vth2 are adjacent, the gradation level of a dark pixel specified by the video signal Vid-in is corrected to the gradation level c1.

As described above, according to this embodiment, it is possible to prevent the occurrence of display defects resulting from the above-described reverse tilt domain in advance. Moreover, since the gradation level of a pixel adjacent to the boundary in the image represented by the video signal Vid-in is locally corrected, the possibility that a change in the displayed image by the correction is perceived by the user is low. Furthermore, in this embodiment, since the number of corrections of the gradation level is smaller than that when the gradation level of all bright pixels adjacent to the boundary in the video signal of the present frame is corrected, it is possible to decrease the loss of information contained in the video signal Vid-in. In addition, in this embodiment, since it is not necessary to apply changes to the structure of the liquid crystal panel 100, the aperture ratio will not decrease, and the invention can be applied to a liquid crystal panel which is not manufactured in advance so as to have a new structure.

Although it has been described that the pixel indicated by *1 in part (5) in FIG. 7 is corrected so as to have the gradation level c1 because it is considered to be adjacent to the applied boundary, the horizontal electric field is considered to have little effect on the pixel because the bright pixel pattern moves in the horizontal direction and the pixel is at the opposing corner of the bright pixel. Therefore, the pixel indicated by *1 may not be corrected so as to have the gradation level c1.

Second Embodiment

Next, a second embodiment of the present invention will be described.

In the following description, the same configurations as the first embodiment will be denoted by the same reference numerals, and detailed description thereof will be appropriately omitted. In the embodiment described above, the gradation level of one barcode reader adjacent to the applied boundary was corrected to the gradation level c1. However, in this embodiment, the gradation level of two or more bright pixels including the bright pixel is corrected to the gradation level c1.

The video processing circuit 30 of this embodiment is different from that of the first embodiment, in that the content determined by the determination portion 310 is changed.

The determination portion 310 determines whether or not the gradation level of the pixel represented by the video signal Vid-d delayed by the delay circuit 312 belongs to the gradation range b and whether or not the pixel is adjacent to the applied boundary detected by the applied boundary determiner 304. The determination portion 310 sets the output signal flag Q, for example, to "1" if all the determination results are "Yes" and sets the flag Q to "0" if any one of the determination results is "No". When the flag Q set for a certain bright pixel is changed from "0" to "1," the determination portion 310 sets the flags Q for two or more bright pixels being continuous to the bright pixel adjacent to the applied boundary to "1". In this example, the determination portion 310 sets the flags Q for three continuous bright pixels to "1".

A specific example of the correction process by the video processing circuit 30 will be described.

Figure 9:
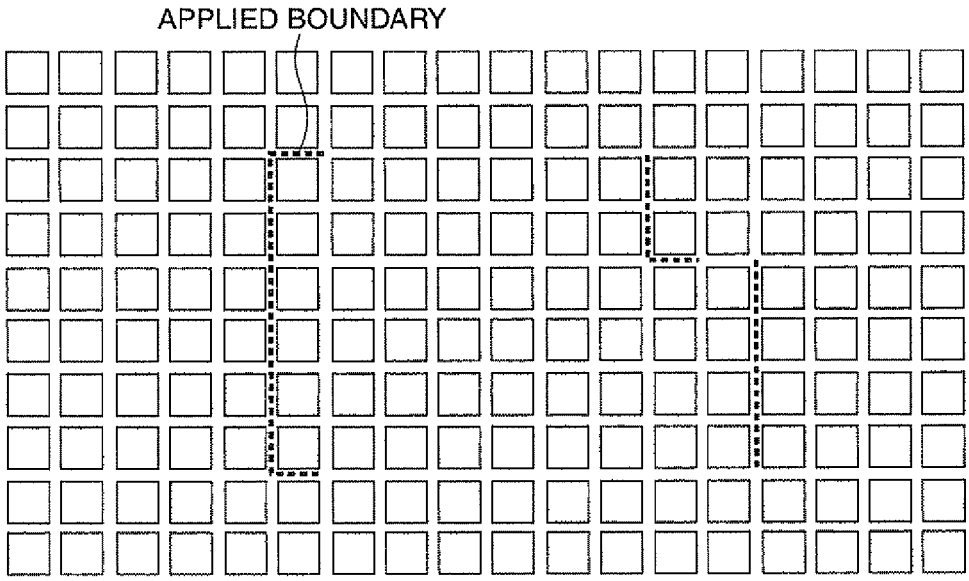
FIG. 9 shows the details of a correction process in a video processing circuit according to a second embodiment of the invention.
Figure 9:
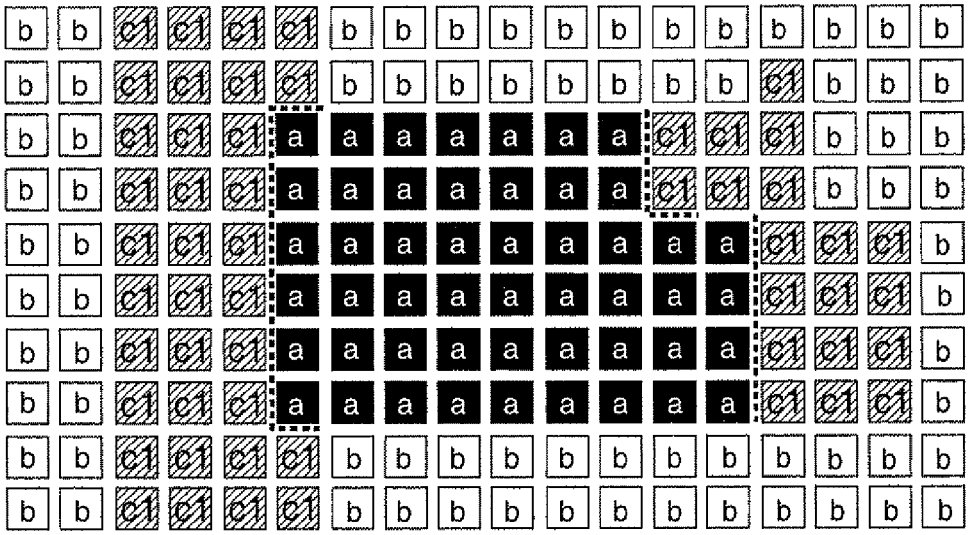

When an image represented by the video signal Vid-in of a frame occurring one frame earlier than the present frame is as shown in part (1) in FIG. 6, for example, and an image represented by the video signal Vid-in of the present frame is as shown in part (2) in FIG. 6, for example, the applied boundary will be detected as shown in part (1) in FIG. 9.

The video processing circuit 30 corrects the video signal so that the respective pixels of a bright pixel group (hereinafter referred to as "a correction target bright pixel group") including two or more continuous bright pixels, including a bright pixel which is adjacent to the applied boundary and of which the gradation level belongs to the gradation range b have the gradation level c1. In this example, the correction target bright pixel group is made up of three continuous bright pixels.

Through the process described above, the image shown in part (1) in FIG. 6 is corrected so as to have the gradation level as shown in part (2) in FIG. 9 by the video processing circuit 30.

In a configuration in which the video signal Vid-in is supplied to the liquid crystal panel 100 without being processed by the video processing circuit 30, in the case of positive-polarity writing, the potentials of the pixel electrodes of dark pixels in the gradation range a and bright pixels in the gradation range b are as shown in FIG. 10A. In contrast, in this example, as shown in FIG. 10B, since the applied voltage to the liquid crystal devices 120 corresponding to the correction target bright pixel group is corrected to a low voltage, it is possible to further decrease the potential difference between adjacent pixels. Therefore, since the potential difference between the pixel electrodes is changed stepwise, it is possible to suppress the effect of the horizontal electric field.

As described above, in the configuration of this embodiment, the same advantage as the first embodiment can be obtained.

Now, it is assumed that the refresh time interval of the display screen of the liquid crystal panel 100 is S (msec) and the response time for the liquid crystal device 120 to enter its alignment state when the applied voltage to the respective correction target bright pixel group is corrected to the voltage Vc1 by the correction portion 300 is T (msec). When the liquid crystal panel 100 is driven at a constant speed, the time interval S is 16.7 msec that is equal to the frame rate. Therefore, if $S(=16.7) \geqq T$, only one pixel that is adjacent to the risk boundary will be enough to be used as the dark pixel of which the gradation level is to be corrected to the gradation level c1. On the other hand, in recent years, the driving speed of the liquid crystal panel 100 is increasing to higher speeds such as 2×, 4×, or higher. In high-speed driving, the high-order device supplies one page of video signals Vid-in for each frame similarly to the constant speed driving. Therefore, in order to improve the visibility of moving images, there is a case where an intermediate image between the n-th frame and the (n+1)-th frame is created through interpolation techniques or the like and displayed on the liquid crystal panel 100. For example, in the case of 2× driving, the refresh time interval of the display screen is 8.35 (msec) that is half that of constant speed driving. Therefore, each frame is divided into the two first and second fields, so that a refresh operation of displaying the image of the present frame is performed in the first field, for example, and a refresh operation of displaying an interpolation image corresponding to the image of the present frame and the image of the next frame is performed in the second field. Therefore, in high-speed driving, there is a case where an image pattern moves by a distance of one frame in the divided fields of a frame.

When F (msec) is the period of a frame in which one page of video signals Vid-in are supplied, if a liquid crystal panel is driven at a U× speed that is U (U is an integer) times faster than the supply speed, the period of one field corresponds to F/U, which is the refresh time interval S of a display screen.

Therefore, when the liquid crystal panel 100 in which the video signals Vid-in are supplied in one frame of 16.7 msec is driven at a 2× speed, the refresh time interval of the display screen is 8.35 msec that is half that of constant speed driving. Here, if the response time T is 24 msec, the preferred number of pixels subjected to correction will be approximately "24/8.35" which is "2.874xxx". Thus, the preferred number is "3" which is an addition of the integer parts "2" and "1".

As described above, according to this embodiment, even when the response time of a liquid crystal device is longer than the refresh time interval of the display screen such as when the liquid crystal panel 100 is driven at the 2× speed or higher, by appropriately setting the number of dark pixels subjected to correction, it is possible to prevent the occurrence of display defects resulting from the above-described reverse tilt domain in advance. Moreover, since the gradation level of a pixel adjacent to the boundary in the image represented by the video signal Vid-in is locally corrected, the possibility that a change in the displayed image by the correction is perceived by the user is low. In addition, in this embodiment, since it is not necessary to apply changes to the structure of the liquid crystal panel 100, the aperture ratio will not decrease, and the invention can be applied to a liquid crystal panel which is not manufactured in advance so as to have a new structure.

In this embodiment, although the liquid crystal 105 is a VA-mode liquid crystal operating in the normally black mode, the liquid crystal 105 may be a TN-mode liquid crystal, for example and the liquid crystal device 120 may operate in a normally white mode wherein it appears white when no voltage is applied. In the normally white mode, the invention is not limited to a configuration in which three continuous dark pixels adjacent to a bright pixel is corrected so as to have the gradation level c1, but the number of pixels subjected to correction may be increased considering the response time of the liquid crystal device 120 and the driving speed of the liquid crystal panel 100.

Third Embodiment

Next, a third embodiment of the invention will be described.

In the following description, the same configurations as the first and second embodiments will be denoted by the same reference numerals, and detailed description thereof will be appropriately omitted. In the first embodiment described above, the bright pixels adjacent to the applied boundary were corrected so as to have the gradation level c1. However, in this embodiment, when a dark pixel and a bright pixel are adjacent to the applied boundary disposed therebetween, and another dark pixel is continuous to the dark pixel, the two or more (plural) dark pixels are corrected so as to have the gradation level c2. The gradation level c2 is a gradation level brighter than the gradation range a. In this embodiment, the gradation level of a bright pixel is not performed.

The video processing circuit 30 of this embodiment is different from that of the first embodiment, in that the video signal input to the selector 314 and the content determined by the determination portion 310 are changed.

A video signal having the gradation level c2 is input to the input terminal b of the selector 314. Since the selector 314 selects the input terminal b if the flag Q is "1," the video signal Vid-d of the present frame is corrected to a video signal that specifies the gradation level c2 and output as the video signal Vid-out.

The determination portion 310 determines whether or not the gradation level of the pixel represented by the video signal Vid-d delayed by the delay circuit 312 belongs to the gradation range a and whether or not the pixel is adjacent to the applied boundary detected by the applied boundary determiner 304. The determination portion 310 sets the output signal flag Q, for example, to "1" if all the determination results are "Yes" and sets the flag Q to "0" if any one of the determination results is "No". When the flag Q set for a certain dark pixel is changed from "0" to "1," the determination portion 310 sets the flags Q for two or more dark pixels including the dark pixel adjacent to the applied boundary to "1". In this example, the determination portion 310 sets the flags Q for three continuous dark pixels to "1".

A specific example of the correction process by the video processing circuit 30 will be described.

Figure 11:
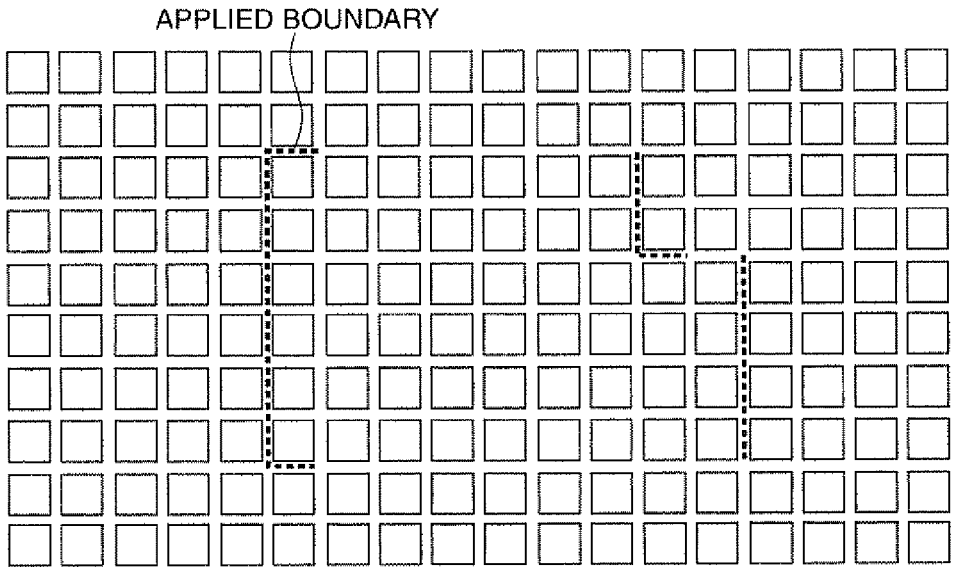
FIG. 11 shows the details of a correction process in a video processing circuit according to a third embodiment of the invention.
Figure 11:
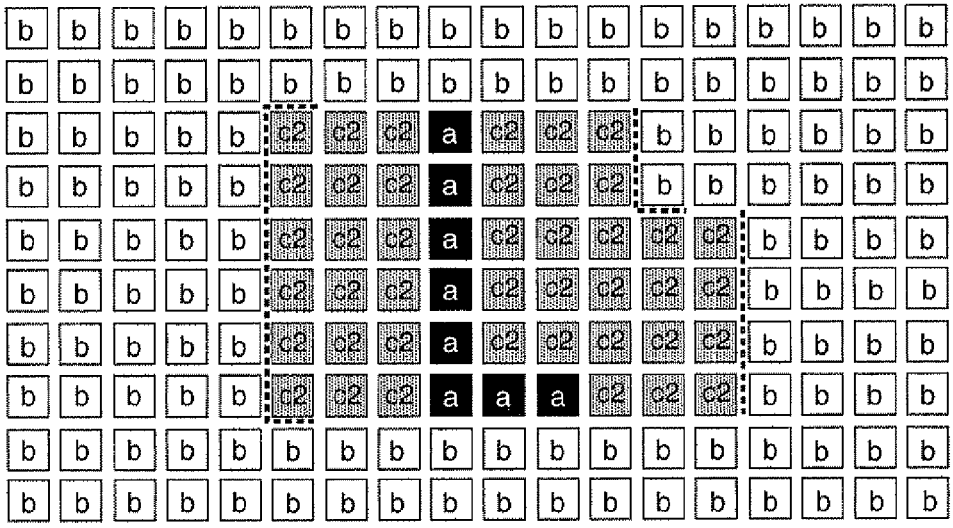

When an image represented by the video signal Vid-in of a frame occurring one frame earlier than the present frame is as shown in part (1) in FIG. 6, for example, and an image represented by the video signal Vid-in of the present frame is as shown in part (2) in FIG. 6, for example, the applied boundary will be detected as shown in part (1) in FIG. 11.

The configuration of the video processing circuit 30 of this embodiment is the same as that of the second embodiment, except that the video signal supplied by the selector 314 is different. In the selector 314, the video signal Vid-d from the delay circuit 312 is supplied to the input terminal a, and a correction video signal having the gradation level c2 is supplied to the input terminal b. The selector 314 selects the input terminal b if the flag Q supplied to the control terminal Sel is "1" and selects the video signal Vid-d supplied to the input terminal a if the flag Q is "0" and outputs either one of the video signals as the video signal Vid-out.

The video processing circuit 30 having the above-described configuration corrects the video signal so that the respective pixels of a dark pixel group (hereinafter referred to as "a correction target dark pixel group") including two or more continuous dark pixels adjacent to the applied boundary with a bright pixel disposed therebetween have the gradation level c2. In this example, the correction target dark pixel group is made up of three continuous dark pixels. The gradation level c2 is expressed by any one of applied voltages equal to or higher than the threshold voltage Vth1 and lower than Vc1. That is, as shown in FIGS. 4A and 43, the gradation level c2 is a gradation level that belongs to the gradation range c and is lower than the gradation level c1.

In a configuration in which the video signal Vid-in is supplied to the liquid crystal panel 100 without being processed by the video processing circuit 30, in the case of positive-polarity writing, the potentials of the pixel electrodes of dark pixels in the gradation range a and bright pixels in the gradation range b are as shown in FIG. 12A. Thus, the horizontal electric field between the dark pixel and the bright pixel increases. In contrast, in this example, as shown in FIG. 123, since the applied voltage to the liquid crystal devices 120 corresponding to the correction target dark pixel group is corrected to a high voltage, it is possible to further decrease the potential difference between adjacent pixels. Therefore, it is possible to further suppress the effect of the horizontal electric field.

In this embodiment, the liquid crystal 105 may be a TN-mode liquid crystal, for example and the liquid crystal device 120 may operate in a normally white mode wherein it appears white when no voltage is applied. In the normally white mode, it may be beneficial to configure the video processing circuit 30 to perform a process wherein, when a bright pixel having a transmittance higher than that when the applied voltage is the threshold voltage Vth1 and a dark pixel having a transmittance equal to or lower than that when the applied voltage is the threshold voltage Vth2 are adjacent, the gradation level of the correction target dark pixel group is corrected to the gradation level c1 and the gradation level of the correction target bright pixel group is corrected to the gradation level c2.

Moreover, the invention is not limited to a configuration in which three continuous bright pixels adjacent to a dark pixel is corrected so as to have the gradation level c2, but the number of pixels subjected to correction may be increased considering the response time of the liquid crystal device 120 and the driving speed of the liquid crystal panel 100.

Fourth Embodiment

Next, a fourth embodiment of the invention will be described.

In the following description, the same configurations as the first to third embodiments will be denoted by the same reference numerals, and detailed description thereof will be appropriately omitted. In the second embodiment described above, the correction target bright pixel group adjacent to the applied boundary was corrected so as to have the gradation level c1. In the third embodiment described above, the correction target dark pixel group adjacent to the applied boundary was corrected so as to have the gradation level c2. However, in this embodiment, the gradation levels of the two pixel groups are corrected.

Figure 13:
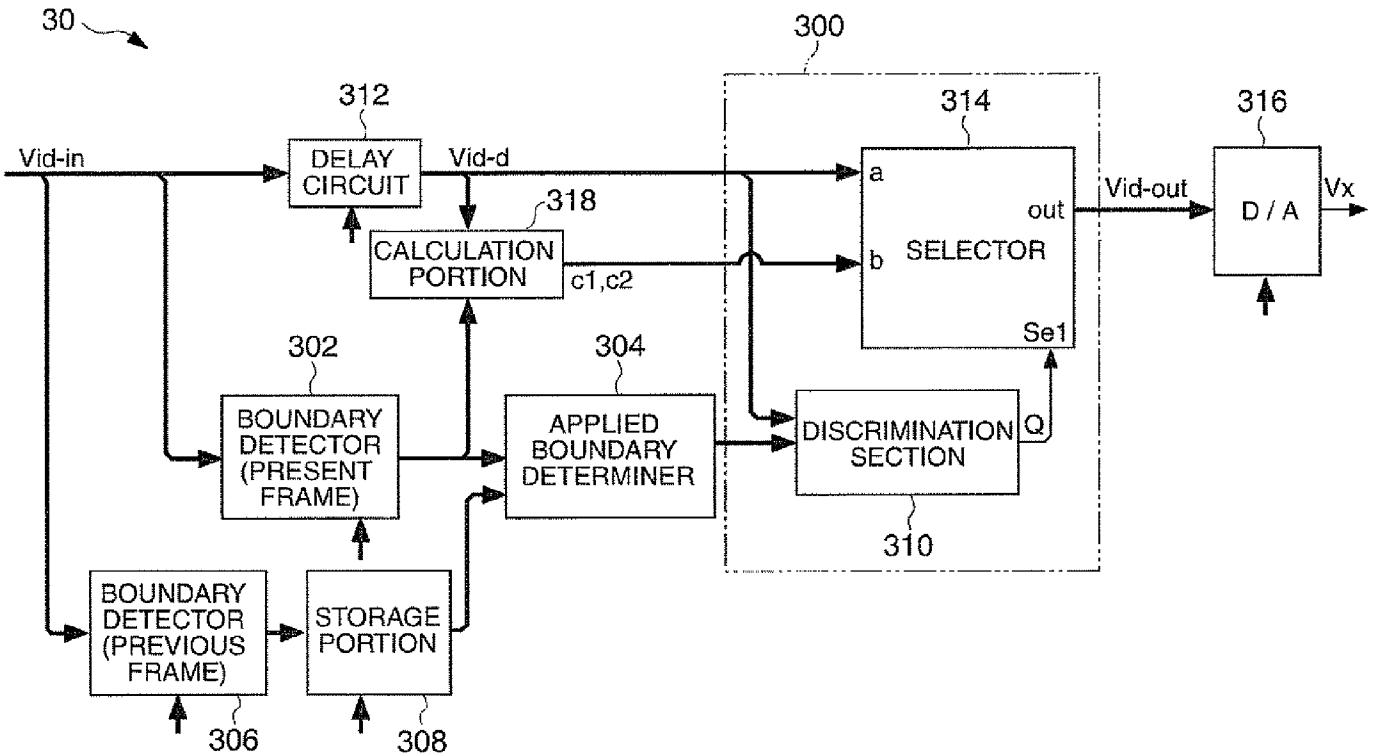
FIG. 13 shows a configuration of a video processing circuit according to a fourth embodiment of the invention.

FIG. 13 is a block diagram showing the configuration of the video processing circuit 30 according to the fourth embodiment. The video processing circuit 30 shown in FIG. 13 is different from the video processing circuit 30 shown in FIG. 3, in that a calculation portion 318 is added, and the content determined by the determination portion 310 is changed.

Specifically, in the case of the normally black mode, the calculation portion 318 calculates and outputs a gradation level c1 if the pixel represented by the delayed video signal Vid-d is a bright pixel and calculates and outputs a gradation level c2 if the pixel is a dark pixel. A video signal having the gradation level c2 is input to the input terminal b of the selector 314. Since the selector 314 selects the input terminal b if the flag Q is "1," the video signal Vid-d of the present frame is corrected to a video signal that specifies the gradation level c2 and is output as the video signal Vid-out.

In such a configuration, when the flag Q output from the determination portion 310 is "1," the video signal Vid-d is corrected so as to have the gradation level output from the calculation portion 318 and is output as the video signal Vid-out.

The determination portion 310 performs both the determination described in the second embodiment and the determination described in the third embodiment. The determination contents have been described above and will not be described further.

A specific example of the correction process by the video processing circuit 30 will be described.

Figure 14:
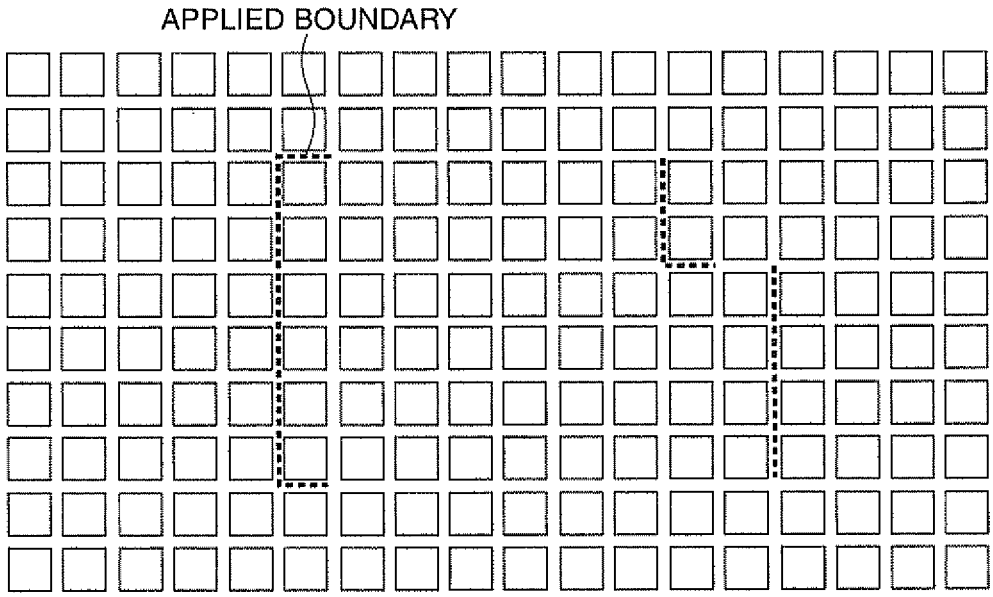
FIG. 14 shows the details of a correction process in the video processing circuit.
Figure 14:
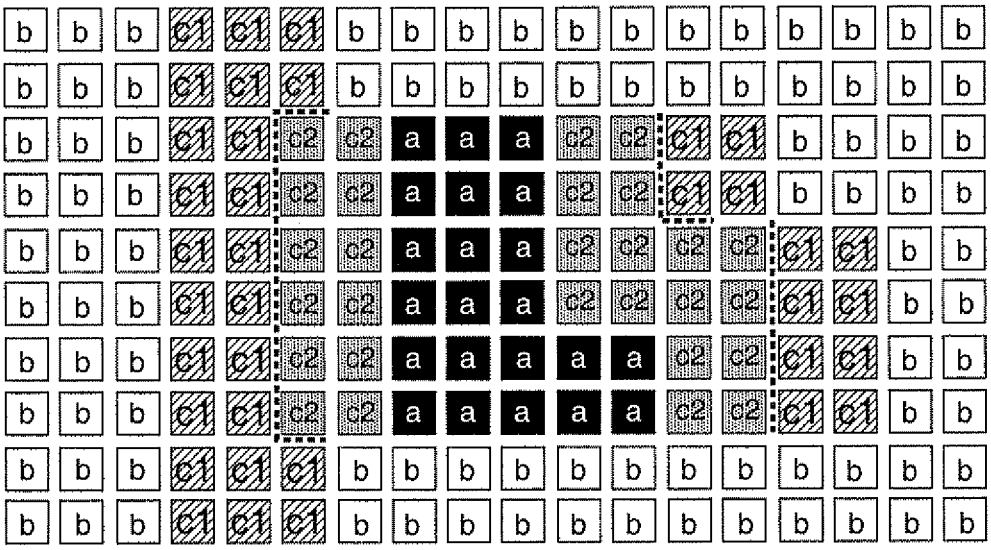

When an image represented by the video signal Vid-in of a frame occurring one frame earlier than the present frame is as shown in part (1) in FIG. 6, for example, and an image represented by the video signal Vid-in of the present frame is as shown in part (2) in FIG. 6, for example, the applied boundary determined by the applied boundary determiner 304 will be detected as shown in part (1) in FIG. 14.

In the video processing circuit 30, the video signal is corrected so that the correction target bright pixel group has the gradation level c1 similarly to the second embodiment, and the correction target dark pixel group adjacent on the opposite side of the correction target bright pixel group with respect to the applied boundary has the gradation level c2 similarly to the third embodiment, and the corrected video signal is output as the video signal Vid-out. Therefore, the image shown in part (2) in FIG. 6 is corrected to the image having the gradation level as shown in part (2) in FIG. 14 by the video processing circuit 30.

In a configuration in which the video signal Vid-in is supplied to the liquid crystal panel 100 without being processed by the video processing circuit 30, in the case of positive-polarity writing, the potentials of the pixel electrodes of dark pixels in the gradation range a and bright pixels in the gradation range b are as shown in FIG. 15A. Thus, the horizontal electric field between the dark pixel and the bright pixel increases. In contrast, in this example, as shown in FIG. 158, since the applied voltage to the liquid crystal devices 120 corresponding to the dark pixel group is corrected to a high voltage, it is possible to further decrease the potential difference between adjacent pixels. Therefore, it is possible to further suppress the effect of the horizontal electric field more so than in that of the configurations of the second and third embodiments. Moreover, in this embodiment, the gradation levels of two or more pixels including a dark pixel and a bright pixel are corrected. Therefore, even when the response time of a liquid crystal device is longer than the refresh time interval of the display screen such as when the liquid crystal panel 100 is driven at the 2× speed or higher, it is possible to prevent the occurrence of display defects resulting from the above-described reverse tilt domain in advance.

According to this embodiment, in addition to the above-mentioned advantage, the same advantage as the second and third embodiments can be obtained, and the number of pixels of which the gradation level is to be corrected among the pixels adjacent to the boundary disposed therebetween may be increased further. In particular, if reverse tilt domain occurs once, it tends to broaden over a portion where the vertical electric field is weak. Moreover, when a region which transitions to a bright pixel moves slowly, and the gradation levels of many pixels are corrected, since the regions subjected to correction increase, it is advantageous from the perspective of suppressing reverse tilt domain. In this embodiment, the liquid crystal 105 may be a TN-mode liquid crystal, for example and the liquid crystal device 120 may operate in a normally white mode wherein it appears white when no voltage is applied.

Fifth Embodiment

Next, a fifth embodiment of the invention will be described.

In the following description, the same configurations as the fourth embodiment will be denoted by the same reference numerals, and detailed description thereof will be appropriately omitted.

A specific example of a correction process by the video processing circuit 30 of this embodiment will be described with reference to FIGS. 16A to 16C to FIGS. 18A and 18B. In the respective drawings, each rectangle corresponds to one pixel, and an alphabet or a combination of alphabet and number inside the rectangle corresponds to each gradation level. Moreover, P1 to P12 are symbols for identifying each pixel, and the number at the end of each symbol increases from the left to the right of the drawings. Furthermore, in the graph below the respective rectangles, the horizontal axis represents the position of each pixel, and the vertical axis represents an applied voltage to a liquid crystal device corresponding to a pixel at each pixel position.

Figure 16A:
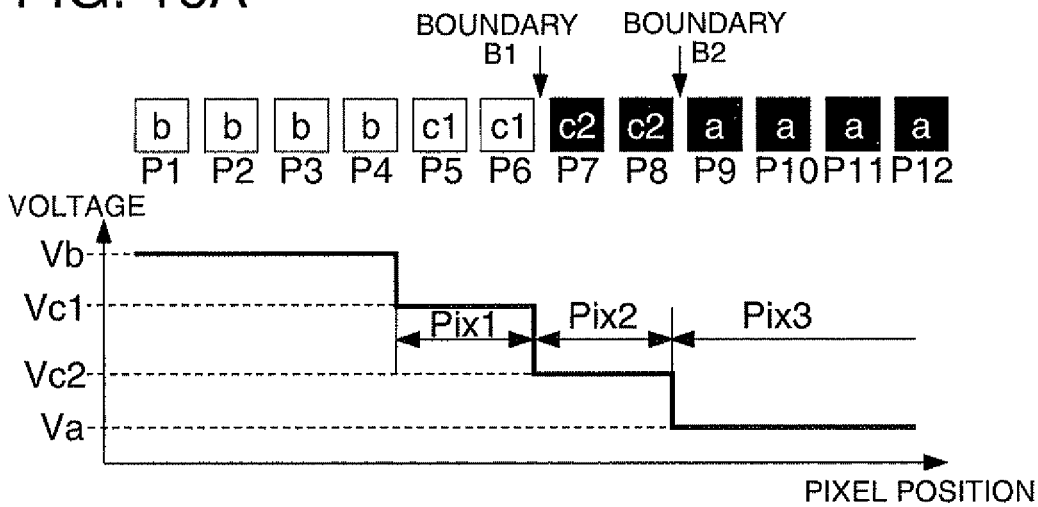
FIGS. 16A to 16C show the details of boundary correction in a video processing circuit according to a fifth embodiment of the invention.

Here, a case where an image of which the gradation level is corrected by the configuration of the second embodiment is as shown in FIG. 16A will be considered. In this case, a correction target bright pixel group Pix1 having the gradation level c1 and a correction target dark pixel group Pix2 having the gradation level c2 are adjacent in the direction of the pixel array with a boundary B1 disposed therebetween. Moreover, a dark pixel group that is different from the correction target dark pixel group Pix2 is continuous to a boundary B2 on the other side of the correction target dark pixel group Pix2. This dark pixel group will be referred to as an "adjacent dark pixel group Pix3" to distinguish it from the correction target dark pixel group Pix2. The gradation level of the respective pixels (third pixels) in the adjacent dark pixel group Pix3 belongs to the gradation range a.

The position of a boundary that is to be perceived by the user is only the boundary B1. However, there is a case where the boundary B2 is also perceived by the user since the gradation level of the correction target dark pixel group Pix2 becomes higher than that of the adjacent dark pixel group Pix3 by the gradation correction for suppressing the occurrence of reverse tilt domain.

Therefore, the video processing circuit 30 of this embodiment performs boundary correction described below so as to suppress an unintended boundary from being visually perceived.

A. Boundary Correction on Correction Target Dark Pixel Group

First, boundary correction on the correction target dark pixel group Pix2 will be described.

Figure 16B:
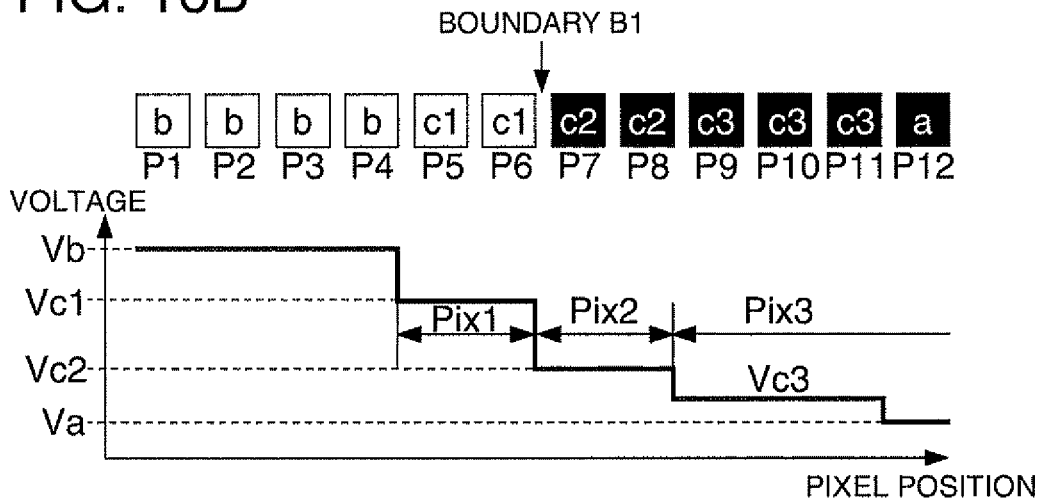

As shown in FIG. 16B, the video processing circuit 30 increases the gradation level of the respective pixels so that the gradation level of the adjacent dark pixel group Pix3 is not higher than the gradation level of the correction target dark pixel group Pix2. This gradation level can be realized by the calculation portion 318 correcting and outputting the gradation level. In this example, the gradation level of each of the pixels P9 to P12 in the adjacent dark pixel group Pix3 is corrected from a to c3 (where a<c3<c2). The applied voltage to the liquid crystal device 120 to obtain the gradation level c3 is Vc3 which is higher than the voltage Va and lower than the voltage Vc2. By the correction of this applied voltage, the gradation level of the adjacent dark pixel group Pix3 has a value between the gradation level "c1" of the correction target dark pixel group Pix2 and the gradation level "a". Thus, the boundary B2 between the pixels P8 and P9 is more barely perceived as compared to a case where no boundary correction is performed.

Figure 16C:
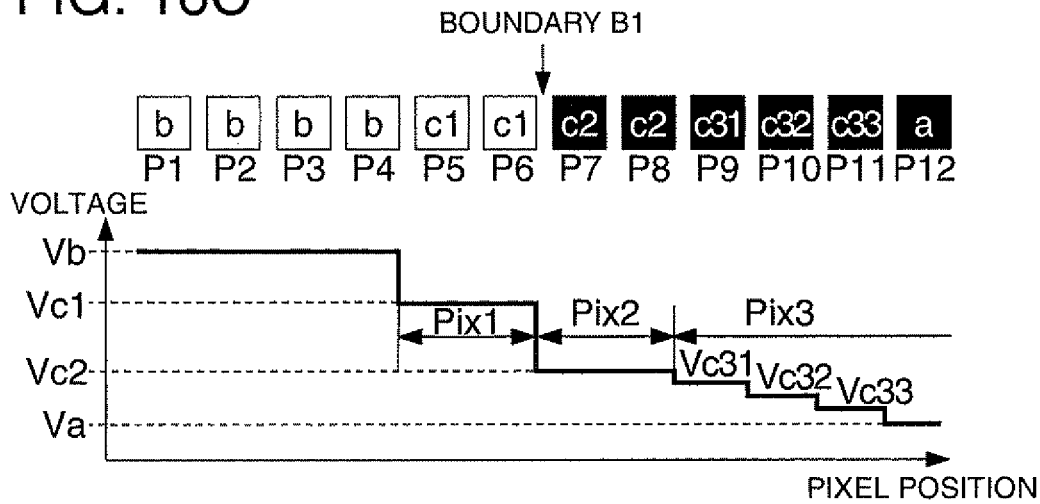

As shown in FIG. 16C, the video processing circuit 30 may correct the gradation level of the respective pixels so as to increase gradually as it gets closer to the boundary B2 rather than correcting the gradation level of the respective pixels of the adjacent dark pixel group Pix3 so as to have the same value. In this example, the pixel P9 has a gradation level c31, the pixel P10 has a gradation level c32, and the pixel P11 has a gradation level c33. The applied voltages for obtaining these respective gradation levels are Vc31, Vc32, and Vc33. In this way, it is possible to make the boundary B2 further more barely visually perceived.

Figure 17A:
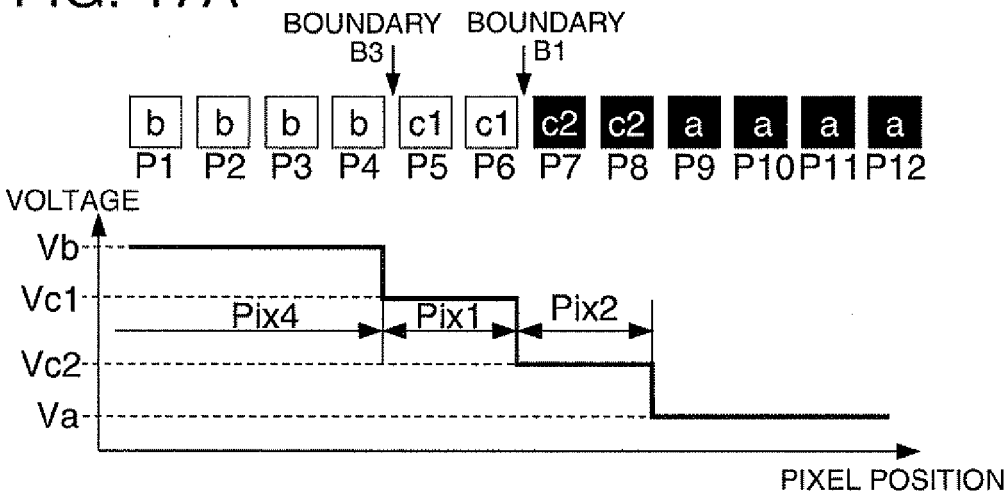
FIGS. 17A to 17C show the details of another boundary correction according to the fifth embodiment.

Moreover, a bright pixel group that is different from the correction target dark pixel group Pix1 is continuous on the opposite side of the boundary B1 with respect to the correction target bright pixel group Pix1 having the gradation level c1. This bright pixel group will be referred to as an "adjacent bright pixel group Pix4" to distinguish it from the correction target bright pixel group Pix1. The gradation level of the respective pixels (fourth pixels) in the adjacent bright pixel group Pix4 belongs to the gradation range b. Here, since the gradation level of the correction target bright pixel group Pix1 is lower than the gradation level of the adjacent bright pixel group Pix4, there is a case where the boundary B3 shown in FIG. 17A is perceived by the user.

Therefore, the video processing circuit 30 may perform boundary correction described below so as to suppress the boundary B3 from being visually perceived.

B. Boundary Correction on Correction Target Bright Pixel Group

Figure 17B:
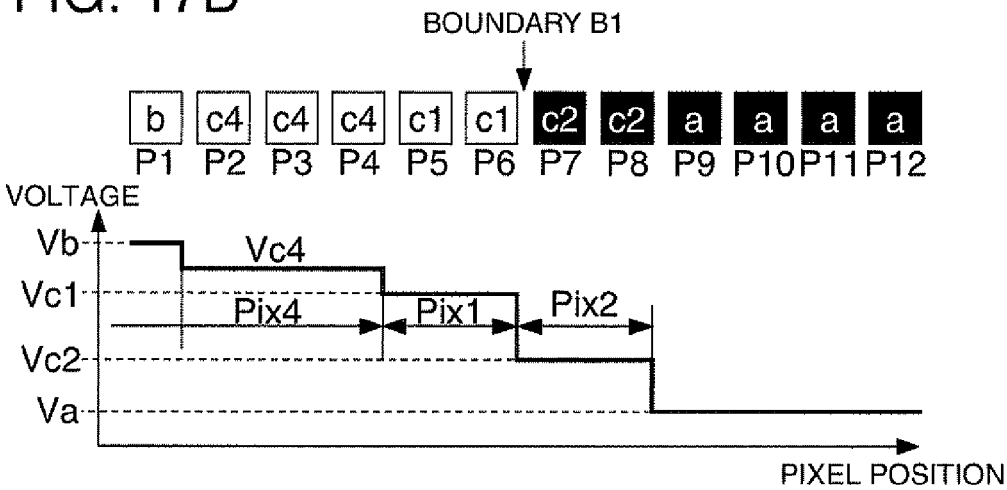

As shown in FIG. 17B, the video processing circuit 30 decreases the gradation level of the respective pixels of the adjacent bright pixel group Pix4 so that the gradation level of the adjacent bright pixel group Pix4 is not higher than the gradation level of the correction target bright pixel group Pix1. In this example, the gradation level of each of the pixels P2 to P4 in the adjacent bright pixel group Pix4 is corrected from b to c4 (where c1<c4<b). The applied voltage to the liquid crystal device 120 to obtain the gradation level c4 is Vc4 which is higher than the voltage Va and lower than the voltage Vc1. By the correction of this applied voltage, the gradation level of the adjacent bright pixel group Pix4 has a value between the gradation level "c1" of the correction target bright pixel group Pix1 and the gradation level "b". Thus, the boundary 83 between the pixels P4 and P5 is more barely perceived as compared to a case where no boundary correction is performed.

Figure 17C:
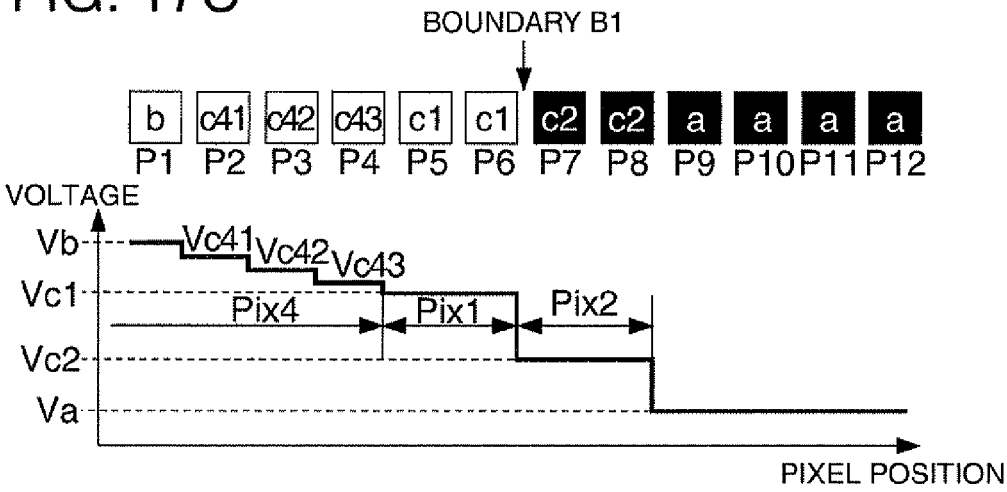

As shown in FIG. 17C, the video processing circuit 30 may correct the gradation level of the respective pixels so as to increase gradually as it gets closer to the boundary B3 rather than correcting the gradation level of the respective pixels of the adjacent bright pixel group Pix4 so as to have the same value. In this example, the pixel P2 has a gradation level c41, the pixel P3 has a gradation level c42, and the pixel P4 has a gradation level c43. The applied voltages for obtaining these respective gradation levels are Vc41, Vc42, and Vc43. In this way, it is possible to make the boundary B3 further more barely visually perceived.

The boundary correction on the correction target bright pixel group may be realized by providing the calculation portion 318 to the video processing circuit 30 of the second embodiment.

C. Correction on Correction Target Dark Pixel Group and Correction Target Bright Pixel Group The video processing circuit 30 may perform both of the correction methods corresponding to "A. Boundary Correction on Correction Target Dark Pixel Group" and "B. Boundary Correction on Correction Target Bright Pixel. Group" described with reference to FIGS. 16A to 16C and FIGS. 17A and 17B, respectively. By doing so, it is possible to make both of the boundaries B2 and B3 barely visually perceived.

Although in the above-described boundary correction, the gradation level of three continuous dark or bright pixels was corrected, the number of pixels may be other numbers. As an example, a sufficient effect of the boundary correction can be also obtained with one to six pixels.

The boundary correction of this embodiment may be performed in the following manner.

Figure 18A:
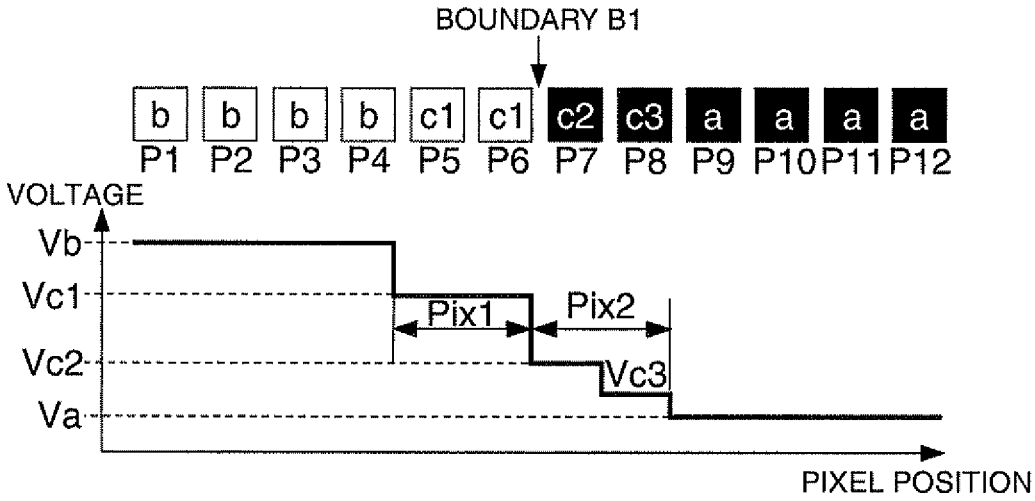
FIGS. 18A and 18B show the details of another boundary correction according to the fifth embodiment.
Figure 18B:
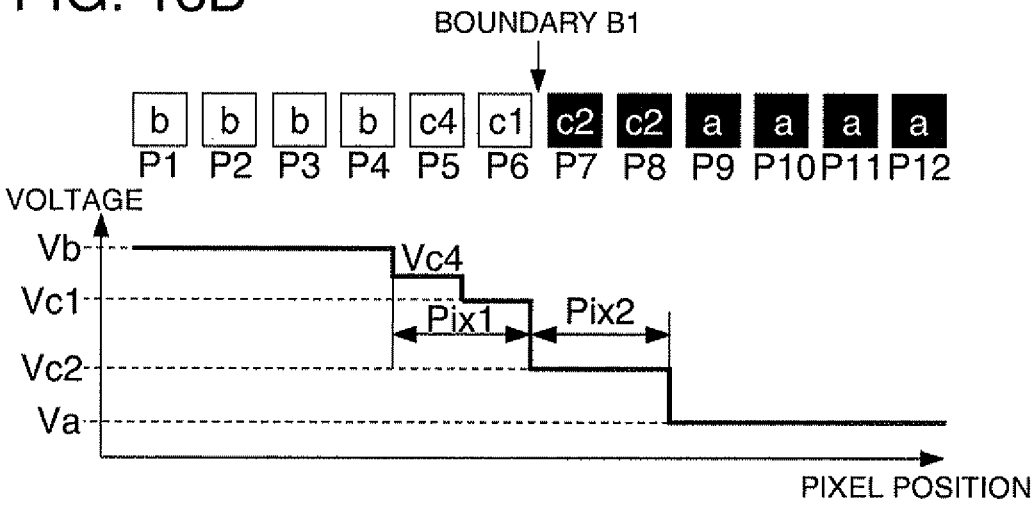

In the example shown in FIG. 18A, the video processing circuit 30 changes the gradation level of the correction target dark pixel group Pix1 and does not change the gradation level of the adjacent dark pixel group Pix3. Specifically, the video processing circuit 30 corrects the gradation level of the pixel P8 to the gradation level c3 that is higher than that of the adjacent dark pixel group Pix3 and is lower than the gradation level c2. In this case, since the difference (difference in applied voltage) in gradation level between the adjacent pixels (the pixels P8 and P9) is small, it is possible to make the boundary B2 barely visually perceived by the user. Moreover, as shown in FIG. 18B, the video processing circuit 30 may change the gradation level of the correction target dark pixel group Pix2 and may not change the gradation level of the adjacent bright pixel group Pix4. Specifically, the video processing circuit 30 corrects the gradation level of the pixel P5 to a gradation level c4 that is lower than that of the adjacent bright pixel group Pix4 and is higher than the gradation level c1. In this case, since the difference in gradation level between the adjacent pixels (the pixels P4 and P5) is small, it is possible to make the boundary B3 barely visually perceived by the user.

As described above, since the video processing circuit 30 performs correction so as to decrease the difference (namely, potential difference) in the gradation level between a pixel group of which the gradation level is corrected so as to suppress the occurrence of reverse tilt domain and a pixel group which is adjacent to the pixel group on the opposite side of a boundary, it is possible to suppress an unintended boundary from being perceived.

Although in the respective embodiments described above, the video signal Vid-in specifies the gradation level of a pixel, the video signal Vid-in may directly specify the applied voltage to the liquid crystal device. When the video signal Vid-in specifies the applied voltage to the liquid crystal device, the boundary may be determined based on the specified applied voltage, and the applied voltage may be corrected.

The gradation levels of the respective pixels of the correction target bright pixel group and the correction target dark pixel group in each of the second and fifth embodiments may not be identical.

Moreover, in the above-described embodiments, the liquid crystal device 120 is not limited to a transmission-type liquid crystal device but may be a reflection-type liquid crystal device. Furthermore, the liquid crystal device 120 is not limited to a normally black mode but may operate in a normally white mode.

In this embodiment, the liquid crystal 105 may be a TN-mode liquid crystal, for example and the liquid crystal device 120 may operate in a normally white mode wherein it appears white when no voltage is applied. In this case, it may be beneficial to configure the video processing circuit 30 so as to increase the applied voltage corresponding to an adjacent dark pixel group so that a difference from the applied voltage to liquid crystal devices corresponding to adjacent dark pixels of a correction target dark pixel group decreases, and to decrease the applied voltage corresponding to an adjacent bright pixel group so that a difference from the applied voltage to liquid crystal devices corresponding to adjacent bright pixels of a correction target bright pixel group.

Electronic Apparatus

Figure 19:
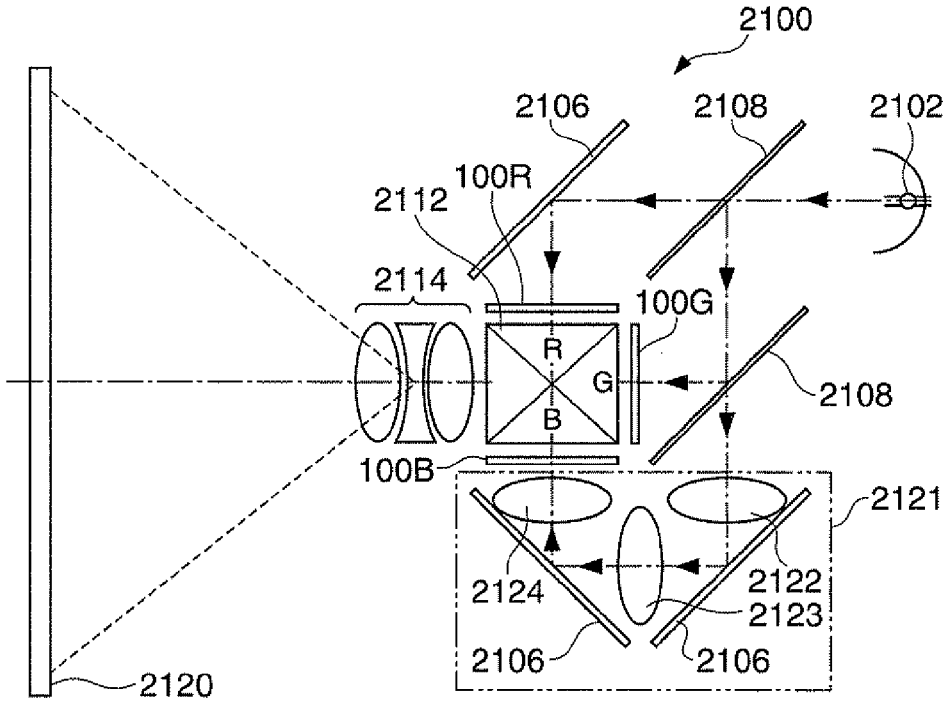
FIG. 19 shows a projector having a liquid crystal display device according to the embodiment.

Next, a projection display apparatus (projector) using the liquid crystal panel 100 as a light valve will be described as an example of an electronic apparatus using the liquid crystal display device according to the above-described embodiment. FIG. 19 is a plan view showing the configuration of this projector.

As shown in the drawing, a lamp unit 2102 formed of a white light source such as a halogen lamp is provided inside a projector 2100. A projection light beam emitted from the lamp unit 2102 is separated into the three primary colors R (red), G (green), and B (blue) by three mirrors 2106 and two dichroic mirrors 2108 disposed in the projector 2100. The three primary color light beams are guided to the corresponding light valves 100R, 100G, and 100B. Since the B light beam passes along a longer optical path than the other R and G light beams, in order to prevent the optical loss, the B light beam is guided through a relay lens system 2121 which includes an incidence lens 2122, a relay lens 2123, and an exiting lens 2124.

In this projector 2100, three liquid crystal display devices each including the liquid crystal panel 100 are provided so as to correspond to the three colors R, G, and B. The light valves 100R, 100G, and 100B have the same configuration as the liquid crystal panel 100 described above. Video signals specifying the gradation levels of the respective primary color components R, G, and B are supplied from an external high-order circuit, whereby the light valves 100R, 100G, and 100B are driven.

Light beams modulated by the light valves 100R, 100G, and 100B enter a dichroic prism 2112 from three directions. In the dichroic prism 2112, the R and B light beams are refracted by 90°, whereas the G light beam passes straight therethrough. Thereafter, the images of the respective primary colors are combined, and a color image is projected onto a screen 2120 by a projection lens 2114.

Since the dichroic mirror 2108 causes light beams corresponding to the colors R, G, and B to enter the corresponding light valves 100R, 100G, and 100B, it is not necessary to provide a color filter. Moreover, since the transmission images of the light valves 100R and 100B are projected after being reflected by the dichroic prism 2112, whereas the transmission image of the light valve 100G is projected without being reflected, the horizontal scanning direction by the light valves 100R and 100B is opposite to the horizontal scanning direction of the light valve 100G, so that horizontally inverted images are displayed.

In addition to the projector described with reference to FIG. 19, examples of the electronic apparatus include televisions, view-finder-type or monitor-direct-view-type video tape recorders, car navigators, pagers, electronic notebooks, electronic calculators, word processors, workstations, video phones, POS terminals, digital-still cameras, portable phones, apparatuses equipped with touch panels, and the like. Moreover, it goes without saying that the liquid crystal display device can be applied to these various types of electronic apparatuses.

The entire disclosure of Japanese Patent Application No. 2010-040925, filed Feb. 25, 2010 is expressly incorporated by reference herein.

What is claimed is:

1. A video processing circuit used in a liquid crystal panel in which a liquid crystal is interposed between a first substrate on which a pixel electrode is provided so as to correspond to each of a plurality of pixels and a second substrate on which a common electrode is provided, and a liquid crystal device is formed of the pixel electrode, the liquid crystal, and the common electrode, the video processing circuit inputting video signals that specify an applied voltage to the liquid crystal device for each of the pixels and defining each of the applied voltages to the liquid crystal devices based on processed video signals, comprising:

a first boundary detector that analyzes a video signal of a present frame to detect a boundary between a first pixel of which the applied voltage specified by the video signal is lower than a first voltage and a second pixel of which the applied voltage is equal to or higher than a second voltage higher than the first voltage;

a second boundary detector that analyzes a video signal of a frame one frame before the present frame to detect a boundary between the first pixel and the second pixel;

an applied boundary determiner that determines a portion obtained by excluding a same portion as the boundary of the frame one frame before the present frame detected by the second boundary detector from the boundary of the present frame detected by the first boundary detector as an applied boundary; and a correction portion that corrects an applied voltage to a liquid crystal device corresponding to a second pixel which is adjacent to a portion of the boundary detected by the first boundary detector, which is changed from the boundary detected by the second boundary detector from the applied voltage specified by the video signal of the present frame to a voltage equal to or higher than the first voltage and lower than the second voltage.

2. The video processing circuit according to claim 1, wherein the correction portion corrects the applied voltages to liquid crystal devices corresponding to the second pixel adjacent to the changed portion and a series of second pixels adjacent to the second pixel to the voltage equal to or higher than the first voltage and lower than the second voltage.

3. The video processing circuit according to claim 2, wherein the correction portion corrects the applied voltages to liquid crystal devices corresponding to the first pixel adjacent to the changed portion and a series of first pixels adjacent to the first pixel from the applied voltage specified by the video signal of the present frame to the voltage equal to or higher than the first voltage and lower than the second voltage and lower than the applied voltages to liquid crystal devices corresponding to the second pixels adjacent to the changed portion disposed therebetween a second pixel continuous to the second pixels.

4. The video processing circuit according to claim 3, wherein the correction portion corrects the applied voltage to a liquid crystal device corresponding to the series of first pixels adjacent to the first pixel adjacent to the changed portion from the applied voltage specified by the video signal of the present frame to a voltage higher than the applied voltage to a liquid crystal device corresponding to a first pixel in which the applied voltage is not corrected and lower than the applied voltage to the first pixel adjacent to the changed portion.

5. A liquid crystal display device comprising:

a liquid crystal panel having a liquid crystal device in which a liquid crystal is interposed between a pixel electrode provided on a first substrate so as to correspond to each of a plurality of pixels and a common electrode provided on a second substrate; and the video processing circuit according to claim 4.

6. An electronic apparatus having the liquid crystal display device according to claim 5.

7. A liquid crystal display device comprising:

a liquid crystal panel having a liquid crystal device in which a liquid crystal is interposed between a pixel electrode provided on a first substrate so as to correspond to each of a plurality of pixels and a common electrode provided on a second substrate; and the video processing circuit according to claim 3.

8. An electronic apparatus having the liquid crystal display device according to claim 7.

9. The video processing circuit according to claim 2, wherein the correction portion corrects the applied voltage to a liquid crystal device corresponding to the series of second pixels adjacent to the second pixel adjacent to the changed portion from the applied voltage specified by the video signal of the present frame to a voltage higher than the applied voltage to a liquid crystal device corresponding to a second pixel in which the applied voltage is not corrected and lower than the applied voltage to the second pixel adjacent to the changed portion.

10. A liquid crystal display device comprising:

a liquid crystal panel having a liquid crystal device in which a liquid crystal is interposed between a pixel electrode provided on a first substrate so as to correspond to each of a plurality of pixels and a common electrode provided on a second substrate; and the video processing circuit according to claim 9.

11. An electronic apparatus having the liquid crystal display device according to claim 10.

12. A liquid crystal display device comprising:

a liquid crystal panel having a liquid crystal device in which a liquid crystal is interposed between a pixel electrode provided on a first substrate so as to correspond to each of a plurality of pixels and a common electrode provided on a second substrate; and the video processing circuit according to claim 2.

13. An electronic apparatus having the liquid crystal display device according to claim 12.

14. A liquid crystal display device comprising:

a liquid crystal panel having a liquid crystal device in which a liquid crystal is interposed between a pixel electrode provided on a first substrate so as to correspond to each of a plurality of pixels and a common electrode provided on a second substrate; and the video processing circuit according to claim 1.

15. An electronic apparatus having the liquid crystal display device according to claim 14.

16. A video processing circuit used in a liquid crystal panel in which a liquid crystal is interposed between a first substrate on which a pixel electrode is provided so as to correspond to each of a plurality of pixels and a second substrate on which a common electrode is provided, and a liquid crystal device is formed of the pixel electrode, the liquid crystal, and the common electrode, the video processing circuit inputting video signals that specify an applied voltage to the liquid crystal device for each of the pixels and defining each of the applied voltages to the liquid crystal devices based on processed video signals, comprising:

a first boundary detector that analyzes a video signal of a present frame to detect a boundary between a first pixel of which the applied voltage specified by the video signal is lower than a first voltage and a second pixel of which the applied voltage is equal to or higher than a second voltage higher than the first voltage;

a second boundary detector that analyzes a video signal of a frame one frame before the present frame to detect a boundary between the first pixel and the second pixel;

an applied boundary determiner that determines a portion obtained by excluding a same portion as the boundary of the frame one frame before the present frame detected by the second boundary detector from the boundary of the present frame detected by the first boundary detector as an applied boundary; and a correction portion that corrects an applied voltage to liquid crystal devices corresponding to a first pixel which is adjacent to a portion of the boundary detected by the first boundary detector, which is changed from the boundary detected by the second boundary detector and a first pixel continuous to the first pixel from the applied voltage specified by the video signal of the present frame to a voltage equal to or higher than the first voltage and lower than the second voltage.

17. A liquid crystal display device comprising:

a liquid crystal panel having a liquid crystal device in which a liquid crystal is interposed between a pixel electrode provided on a first substrate so as to correspond to each of a plurality of pixels and a common electrode provided on a second substrate; and the video processing circuit according to claim 16.

18. An electronic apparatus having the liquid crystal display device according to claim 17.

19. A video processing method used in a liquid crystal panel in which a liquid crystal is interposed between a first substrate on which a pixel electrode is provided so as to correspond to each of a plurality of pixels and a second substrate on which a common electrode is provided, and a liquid crystal device is formed of the pixel electrode, the liquid crystal, and the common electrode, the video processing method inputting video signals that specify an applied voltage to the liquid crystal device for each of the pixels and defining each of the applied voltages to the liquid crystal devices based on processed video signals, comprising:

analyzing a video signal of a present frame to detect a boundary between a first pixel of which the applied voltage specified by the video signal is lower than a first voltage and a second pixel of which the applied voltage is equal to or higher than a second voltage higher than the first voltage;

analyzing a video signal of a frame one frame before the present frame to detect a boundary between the first pixel and the second pixel;

determining an applied boundary by excluding a same portion as the boundary of the frame one frame before the present frame from the boundary of the present frame using an applied boundary determiner; and correcting an applied voltage to a liquid crystal device corresponding to a second pixel which is adjacent to a portion of the boundary detected in the present frame, which is changed from the boundary detected in the frame one frame before the present frame from the applied voltage specified by the video signal of the present frame to a voltage equal to or higher than the first voltage and lower than the second voltage.

20. A video processing method of inputting video signals that specify an applied voltage to a liquid crystal device for each pixels and defining each of the applied voltages to the liquid crystal devices based on processed video signals, comprising:

analyzing a video signal of a present frame to detect a boundary between a first pixel of which the applied voltage specified by the video signal is lower than a first voltage and a second pixel of which the applied voltage is equal to or higher than a second voltage higher than the first voltage;

analyzing a video signal of a frame one frame before the present frame to detect a boundary between the first pixel and the second pixel;

determining an applied boundary by excluding a same portion as the boundary of the frame one frame before the present frame from the boundary of the present frame using an applied boundary determiner; and correcting an applied voltage to liquid crystal devices corresponding to a first pixel which is adjacent to a portion of the boundary detected in the present frame, which is changed from the boundary detected in the frame one frame before the present frame and a first pixel continuous to the first pixel from the applied voltage specified by the video signal of the present frame to a voltage equal to or higher than the first voltage and lower than the second voltage.

* * * * *